US007658190B1

(12) United States Patent
Phifer et al.

(10) Patent No.: US 7,658,190 B1
(45) Date of Patent: Feb. 9, 2010

(54) PORTABLE AIR-PURIFYING SYSTEM UTILIZING ENCLOSED FILTERS

(75) Inventors: Jerry Allen Phifer, Peachland, NC (US); William Eugene Parson, Indian Trail, NC (US); Judge W. Morgan, III, Oakboro, NC (US); Robert Daniel Williams, Monroe, NC (US)

(73) Assignee: STI Licensing Corp., Beachwood, OH (US)

( * ) Notice: Subject to any disclaimer, the term of this patent is extended or adjusted under 35 U.S.C. 154(b) by 0 days.

(21) Appl. No.: 11/100,257

(22) Filed: Apr. 6, 2005

Related U.S. Application Data

(60) Provisional application No. 60/560,401, filed on Apr. 6, 2004.

(51) Int. Cl.
*A62B 18/08* (2006.01)
*A62B 19/00* (2006.01)

(52) U.S. Cl. ..... 128/206.17; 128/201.25; 128/201.29; 128/204.26; 128/205.12; 128/205.11; 128/205.22; 128/205.27; 128/205.28; 128/206.11; 128/205.29; 128/206.16; 128/201.26; 128/202.26; 95/90; 95/91; 95/273; 96/108; 96/121; 96/133; 96/142; 55/467; 55/471; 55/472; 55/473; 55/484; 55/DIG. 35

(58) Field of Classification Search ..... 128/201.25, 128/201.29, 204.26, 205.12, 205.11, 205.22, 128/205.27, 205.28, 206.11, 205.29, 206.16, 128/206.17, 201.26, 202.26; 95/90, 91, 273; 96/108, 121, 133, 142; 55/467, 471–473, 55/484, DIG. 35
See application file for complete search history.

(56) References Cited

U.S. PATENT DOCUMENTS

| | | | | |
|---|---|---|---|---|
| 5,290,330 | A * | 3/1994 | Tepper et al. | 96/381 |
| 5,640,952 | A * | 6/1997 | Swann et al. | 128/206.17 |
| 5,878,742 | A | 3/1999 | Figueredo et al. | |
| 6,016,804 | A | 1/2000 | Gleason et al. | |
| 6,050,262 | A | 4/2000 | Jay | |
| 6,170,483 | B1 | 1/2001 | Ronjat | |
| 6,328,031 | B1 | 12/2001 | Tischer et al. | |
| 6,412,485 | B1 | 7/2002 | Saieva | |

(Continued)

FOREIGN PATENT DOCUMENTS

WO WO 2004/105879 A1 12/2004

*Primary Examiner*—Patricia M Bianco
*Assistant Examiner*—Nihir Patel
(74) *Attorney, Agent, or Firm*—Wyatt Pratt; Dean D. Small; Small Patent Law Group

(57) ABSTRACT

A powered air-purifying respirator that includes an enclosure, defining a single contiguous enclosed interior, an inlet duct, including an inlet and a distribution portion, that guides ambient air to the interior of the enclosure, a plurality of filter canisters disposed within the interior of the enclosure, and a blower that forces air through the at least one inlet, into the interior of the enclosure and through the plurality of filter canisters to produce filtered air suitable for breathing. A valve controls the flow of ambient air through the inlet duct. A fluid dam, disposed in an air path between the inlet and the filter canisters prevents liquids from reaching the filter canisters. The enclosure is reinforced and is adapted to provide protection for the filter canister from flame and heat while the filter canister is in use. A recirculation valve recycles previously-filtered air back into the enclosure.

31 Claims, 19 Drawing Sheets

U.S. PATENT DOCUMENTS

| | | | | |
|---|---|---|---|---|
| 6,478,025 | B1 | 11/2002 | Yort et al. | |
| 6,553,989 | B1 | 4/2003 | Richardson et al. | |
| 6,564,799 | B2 | 5/2003 | Fukunaga et al. | |
| 6,575,165 | B1 | 6/2003 | Cook et al. | |
| 6,578,572 | B2 | 6/2003 | Tischer et al. | |
| 6,584,976 | B2 | 7/2003 | Japuntich et al. | |
| 6,619,285 | B2 | 9/2003 | Hawkins, Jr. et al. | |
| 6,675,800 | B2 | 1/2004 | Keller | |
| 6,684,881 | B2 | 2/2004 | Franberg | |
| 6,761,162 | B1 | 7/2004 | Swann | |
| 6,772,762 | B2 | 8/2004 | Piesinger | |
| 6,796,304 | B2 | 9/2004 | Odell et al. | |
| 6,817,359 | B2 | 11/2004 | Deas et al. | |
| 6,895,960 | B2 | 5/2005 | Fabin | |
| 6,948,191 | B2 | 9/2005 | Avery et al. | |
| 2001/0010225 | A1 | 8/2001 | Keller | |
| 2002/0092522 | A1 | 7/2002 | Fabin | |
| 2002/0170561 | A1 | 11/2002 | Downey | |
| 2003/0024529 | A1 | 2/2003 | Beizndtsson et al. | |
| 2003/0131846 | A1 | 7/2003 | Campbell et al. | |
| 2003/0192103 | A1 | 10/2003 | Avery et al. | |
| 2003/0192536 | A1 | 10/2003 | Odell et al. | |
| 2003/0192537 | A1 | 10/2003 | Odell et al. | |
| 2004/0040561 | A1 | 3/2004 | Tayebi | |
| 2004/0182394 | A1* | 9/2004 | Alvey et al. | 128/205.22 |
| 2004/0182395 | A1* | 9/2004 | Brookman | 128/205.22 |
| 2004/0226563 | A1 | 11/2004 | Xu et al. | |
| 2005/0022817 | A1 | 2/2005 | Alvey | |
| 2005/0051169 | A1 | 3/2005 | Gossweiler | |
| 2005/0103335 | A1 | 5/2005 | Fabin | |
| 2005/0223902 | A1 | 10/2005 | Lovell | |
| 2005/0241642 | A1 | 11/2005 | Krzysztofik | |
| 2006/0009971 | A1 | 1/2006 | Kushner et al. | |
| 2006/0020451 | A1 | 1/2006 | Kushner et al. | |

* cited by examiner

20

110

110

140

140

PORTABLE AIR-PURIFYING SYSTEM UTILIZING ENCLOSED FILTERS

CROSS-REFERENCE TO RELATED APPLICATION

This application is entitled to the benefit of, and claims priority to provisional U.S. Patent Application Ser. No. 60/560,401 filed Apr. 6, 2004 and entitled "Combined Air-Supplied/Armored Air-Purifying System," the entirety of which is incorporated herein by reference.

BACKGROUND OF THE PRESENT INVENTION

1. Field of the Present Invention

The present invention relates generally to respirator apparatuses, and, in particular, to a portable powered air-purifying respirator utilizing one or more enclosed filters.

2. Background

A variety of apparatuses for providing breathable air in hazardous environments are well known. Two particularly common types are the air filtration type, in which ambient air is filtered to remove harmful contaminants so that the air may be breathed safely by the user, and the self-contained breathing apparatus ("SCBA") type, in which a pressure vessel containing a supply of breathable air is carried by the user and used as necessary. Each of these types has been in use for decades.

More recently, these two types of apparatuses have been combined to provide greater flexibility for the user. A combination SCBA/air filtration respirator can be used by civil defense workers, first responders, HazMat teams and military forces to allow users the ability to increase their dwell time in an environment that is or could be contaminated with materials or chemicals harmful to the respiratory tract. The SCBA provides respiratory protection by providing the user a supply of air from a pressure vessel. The air filtration respirator employs filter canisters which filter the harmful materials or chemicals from the air provided to the user. The air filtration respirator can take one of two forms: either a purely negative pressure device or a blower assisted device. In a purely negative pressure air filtration respirator the user is required to draw air through the filter canisters with his lungs. In a blower assisted device, the user is assisted in drawing the air through the filter canister by means of an electronic blower inline with the air flow. The blower assisted device is typically referred to in the industry as a Powered Air Purifying Respirator ("PAPR").

Current respirator configurations are typically limited to either a respirator used for air filtration or a respirator that provides a positive pressure supply of air from a pressure vessel. By providing both types of respiratory protection, a user is able to dwell in an area of potential contamination, or an area of contamination that is not classified as immediately dangerous to life and health ("IDLH") by using the air filtration mode of respiratory protection. Then, if the user is required to enter an IDLH environment or the current environment becomes IDLH, the user is able to switch to SCBA respirator and to breathe supplied air from a pressure vessel. Finally, the user is able to switch back to the air filtration mode after exiting the IDLH environment, and maintain respiratory protection for exiting the environment and or throughout the process of decontamination. The important factor is to allow the user to switch back and forth between breathing modes without exposing the user to the ambient environment.

An example scenario for the use of such a configuration would be that of a HazMat team working to clean up a hazardous chemical spill inside of a large building. While at the site of the spill the users will require the respiratory protection of an SCBA. However, they must transit a large distance through the building to the actual site of the spill. During this transit the user also requires respiratory protection, although the respiratory hazard only requires an air filtration protection. If this scenario were played out with a user equipped only with an SCBA, one can readily see that the actual dwell time at the spill site is reduced, since a portion of the compressed air used by the SCBA is consumed in transit into and out of the building. If the user was equipped with a combined SCBA/air filtration respirator, the transit into and out of the building can be performed using the air filtration respirator, and the SCBA used only when needed at the spill site. In this way, the user will be able to maximize their time to accomplish their mission.

Another example scenario for the use of such a configuration would be that of a military fire fighter:

- Personnel in a military fire-fighting unit are each equipped with the combination SCBA/PAPR respirator. The SCBA is used without the PAPR during normal fire fighting duties.
- In the event of a chemical or biological attack, the fire fighting personnel will each don the facepiece and PAPR, wearing this configuration as long as the they are in a stand-by condition, and as such are protected from the chemical or biological environment.
- If, during the chemical or biological attack, and while wearing the PAPR, the personnel are called on for fire fighting duties, the PAPR can be attached to the SCBA and the combined unit can then be donned. The user can then switch to the SCBA as necessary for fire fighting.
- Upon exiting the fire environment, if a user has been contaminated by the chemical or biological attack, he will switch to the PAPR, then doff the SCBA and remove the PAPR from the SCBA. Throughout this cycle the user has maintained his respiratory protection, and is now ready to proceed a decontamination cycle.

Combining the two types of respirators may not be a new concept; however the method of combining the two, as well as their configurations described below are unique and novel.

Another issue with regard to conventional PAPR designs is that they merely provide a breathing assist to the user, and allow the facepiece pressure to go negative in cases of heavy respirations. Unfortunately, this often causes the user's face seal to leak, thus exposing the user to the ambient environment. This may be prevented by maintaining positive pressure inside the user's facepiece. However, in order for the PAPR to provide the user with enough air flow to maintain positive pressure, even at high respiratory rates, a constant high flow of air must be generated. Testing has shown that respiratory rates for heavy work can be on the order of 100 liters per minute ("lpm"). If a sinusoidal breathing cure is assumed for human breathing, this equates to peak air flow rates in excess of 300 lpm. This means that for the PAPR to maintain positive pressure, a flow rate of at least 300 lpm should be provided to the facepiece. The problem that this situation presents relates to the exhalation of the user. First, the user only actually needs a 300 lpm or higher flow rate for a small portion of each breathing cycle; the remainder of the air supplied to the facepiece is dumped out of the exhalation valve of the facepiece. This represents air that was filtered and not used by the user. Second, with this flow of 300 lpm or higher entering the facepiece, the same peak flows apply when the user is in the exhalation portion of the breathing cycle, which means that the exhalation valve must be capable of handling 600 lpm or higher peak flows (PAPR supplied flow+user exhalation flow). In order to accommodate flows of this magnitude without presenting high exhalation pressures to the user, overly large exhalation valves are required. Thus, a need exists for an improved approach to dealing with this problem.

Yet another issue with regard to conventional PAPR designs is that they are not intended to be carried into fires or other high-heat environments. The filter canisters used in typical PAPR's are not constructed to withstand flame, high heat or the like because such requirements have rarely heretofore been necessary. One recent approach to protecting the filter canisters is to cover each canister with a "bootee" to protect it until the canister is to be used. Unfortunately, such a design requires the additional step of removing the bootee, which is time-consuming and awkward. In addition, once removed, the bootees must be carried or stored safely, which is bothersome for the user. Still further, neither the bootees nor any other known device provides means for closing off air access to the filter canisters, for balancing the air flow between filter canisters when a plurality of filter canisters are utilized and thereby providing uniform wear on the filter canisters, or for otherwise providing functionality only available through the usage of an enclosure to control air flow in and out of the filter canisters.

SUMMARY OF THE PRESENT INVENTION

The subject respirator employs a PAPR with several unique features. Since the PAPR can potentially be carried into a fire fighting environment, it must be protected from all of the hazards found there. Importantly, the filter canisters that the PAPR uses for air filtration are susceptible to heat, flame, water and humidity. Since all of these hazards can be found in the fire scene, the protection of the filter canisters is of utmost importance. The subject respirator's PAPR employs an enclosure that completely contains the filter canisters. The inlet to the enclosure provides a tortuous path for air entering the enclosure, thereby preventing the filter canisters from being exposed to the above hazards. In some embodiments, an inlet duct may also be opened and closed, providing further protection. If provided, such a duct may include an inlet cover that may be manually operated, or operated through electronic or pneumatic controls. With or without the inlet duct, the enclosure also provides the side benefit of streamlining the PAPR by covering the canister's various protrusions, which can be snag hazards for fire fighters.

The present invention comprises a portable air-purifying system utilizing one or more enclosed filter. Broadly defined, the present invention according to one aspect is a powered air-purifying respirator including: an enclosure, defining a single contiguous enclosed interior; at least one inlet that guides ambient air to the interior of the enclosure; a plurality of filter canisters disposed within the interior of the enclosure; a blower that forces air through the at least one inlet, into the interior of the enclosure and through the plurality of filter canisters to produce filtered air suitable for breathing.

In features of this aspect, the at least one inlet distributes ambient air to each of the plurality of filter canisters disposed within the interior of the enclosure; the enclosure is reinforced to prevent the plurality of filter canisters from being damaged by external forces; the powered air-purifying respirator further includes a support structure adapted to receive and retain each of the plurality of filter canisters, and the enclosure is primarily mounted to the support structure and not the filter canisters in order to avoid translating external forces from the enclosure to the filter canisters; the powered air-purifying respirator further includes a fluid dam disposed in an air path between the at least one inlet and at least one of the plurality of filter canisters and adapted to prevent liquids from reaching the at least one filter canister; the enclosure defines a single compartment in which the plurality of filter canisters are disposed; and the enclosure defines a plurality of separate compartments, wherein each filter canister is disposed in a different one of the plurality of separate compartments.

The present invention according to another aspect is an air-purifying respirator including: an enclosure, defining a single contiguous enclosed interior; an inlet duct that guides ambient air to the interior of the enclosure; a valve that controls the flow of ambient air through the inlet, duct; at least one filter canister disposed within the interior of the enclosure; and a fluid connection apparatus that guides filtered air from the outlet of the filter canister to be breathed by a user.

In features of this aspect, the air-purifying respirator further includes a blower that forces air through the inlet duct, into the interior of the enclosure and through the filter canisters to produce filtered air suitable for breathing; the valve is adjustable between at least a first state in which ambient air is permitted to flow through the inlet duct and a second state in which ambient air is prevented from flowing through the inlet duct; and the inlet duct includes a single inlet and the valve consists of an inlet cover that may removed from and replaced in the inlet to control whether ambient air is permitted to flow through the inlet duct or not.

The present invention according to another aspect is an air-purifying respirator including: an enclosure, defining a single contiguous enclosed interior volume; at least two filter canisters disposed within the interior of the enclosure; an inlet duct that guides ambient air to the interior of the enclosure and includes an inlet through which ambient air enters the inlet duct and a distribution portion that directs approximately equal portions of the ambient air that enters the inlet to each of the at least two filter canisters; and a fluid connection apparatus that guides filtered air from the outlet of the at least two filter canisters to be breathed by a user.

In features of this aspect, the air-purifying respirator further includes a blower that forces air through the inlet duct, into the interior of the enclosure and through the at least two filter canisters to produce filtered air suitable for breathing; the distribution portion is a generally symmetric chamber having at least two sets of air outlets, each set including one or more air outlets dedicated to routing air to a particular one of the at least two filter canisters; the enclosure defines a separate compartment for each of the at least two filter canisters, and each set of air outlets guides air from the chamber to exactly one of the compartments; the distribution portion includes at least two duct holes of different sizes, each duct hole being adapted to route air to a different one of the at least two filter canisters; the size of each duct hole is directly related to its distance from the inlet, with the smallest duct hole being the one located closest to the inlet, thereby balancing the amount of airflow received by the at least two filter canisters; and the filter canisters are arranged generally linearly, while the distribution portion extends generally linearly adjacent to the filter canisters, and the duct holes are arranged generally linearly within the distribution portion, thereby causing air entering larger duct holes to first flow past the smallest duct hole.

The present invention according to another aspect is an air-purifying respirator including: an enclosure, defining a single contiguous enclosed interior; at least one inlet that guides ambient air to the interior of the enclosure; a filter canister disposed within the interior of the enclosure; a fluid connection apparatus that guides filtered air from the outlet of the filter canister to be breathed by a user; and a fluid dam disposed in an air path between the at least one inlet and the filter canister and adapted to prevent liquids from reaching the filter canister.

In features of this aspect, the air-purifying respirator further includes a blower that forces air through the at least one inlet, into the interior of the enclosure and through the filter canister to produce filtered air suitable for breathing; a chamber is disposed in the air path between the at least one inlet and the filter canister, the chamber has an air outlet in the bottom thereof, and the fluid dam is arranged peripherally around the air outlet in the chamber; the fluid dam includes a raised lip extending around the periphery of the air outlet; the bottom of the chamber defines a first side of the chamber and the fluid dam defines a first fluid dam, the chamber has at least a second air outlet in a second side thereof, a second fluid dam is arranged peripherally around the second air outlet, and the second side of the chamber is oriented in a substantially different direction than the first side, thereby preventing liquids from reaching the filter canister regardless of the orientation of the air-purifying respirator; the second side of the chamber is the top of the chamber, and the second fluid dam extends downwardly from the top of the chamber; and a first filter canister is disposed below the chamber and the first air outlet is arranged to guide air to the first filter canister, and a second filter canister is disposed above the chamber and the second air outlet is arranged to guide air to the second filter canister.

The present invention according to another aspect is a portable powered air-purifying respirator, including: a housing adapted to be carried by a user; a filter canister, mounted on the housing and adapted to filter ambient air, thereby making it suitable for breathing by the user; a reinforced enclosure having at least one inlet to permit ambient air to be channeled to the filter canister, the enclosure being mounted on the housing, arranged to surround the filter canister, and adapted to provide protection for the filter canister from flame and heat while the filter canister is being used to filter ambient air for the user; and a blower that forces air through the at least one inlet in the enclosure and through the filter canister to produce filtered air suitable for breathing.

In features of this aspect, the filter canister has an inlet at a first end and an outlet at a second end, and the at least one inlet of the reinforced enclosure is disposed near the second end of the filter, thereby causing air that passes through the enclosure and then through the filter canister to be routed along a circuitous path before entering the filter canister; the filter canister may be replaced without replacing the reinforced enclosure; the reinforced enclosure is adapted to be temporarily removed to permit the filter canister to be replaced; the reinforced enclosure is latched in place during use and temporarily unlatched while the filter canister is being replaced; the filter canister includes at least a second filter canister, and wherein the reinforced enclosure includes at least a second reinforced enclosure; the powered air-purifying respirator further includes a valve that controls the flow of ambient air through the at least one inlet of the enclosure; and the housing includes a support structure adapted to receive and retain the filter canister, and the enclosure is primarily mounted to the support structure and not the filter canister in order to avoid translating external forces from the enclosure to the filter canister.

The present invention according to another aspect is an air-purifying respirator, including: an enclosure, defining a single contiguous enclosed interior; a filter canister disposed within the interior of the enclosure; an ambient air inlet that guides ambient air to the interior of the enclosure; a fluid connection apparatus that guides filtered air from the outlet of the filter canister to be breathed by a user; and a recirculation valve, disposed in the fluid connection apparatus, that opens to permit air in the fluid connection apparatus to be returned to the interior of the enclosure.

In features of this aspect, the air-purifying respirator further includes a blower that forces air through the ambient air inlet, into the interior of the enclosure and through the filter canisters to produce filtered air suitable for breathing; the recirculation valve is a biased pressure relief valve located in the air path between the blower and a βfacepiece worn by the user; the recirculation valve is biased to open only when the pressure in the air path between the blower and the facepiece exceeds a predetermined pressure; the predetermined pressure is 1.5" $H_2O$; the recirculation valve is biased to remain closed while the user is inhaling, but opens while the user is exhaling to dump excess air flow to the interior of the enclosure; and the recirculation valve dumps excess air flow to the interior of the enclosure, thereby recycling excess air that has already been filtered by the filter canister.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
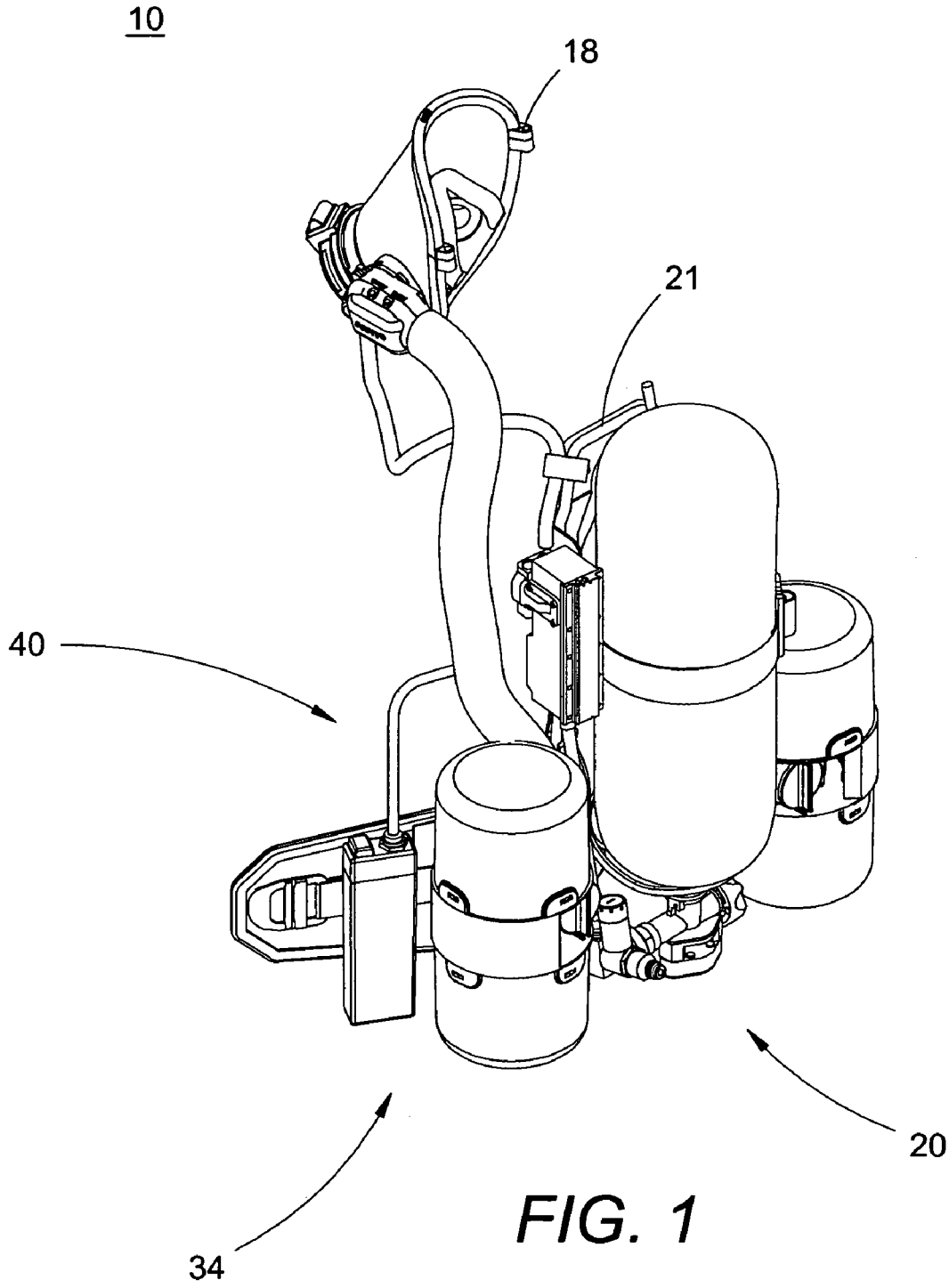
FIG. 1 is a front perspective view of a combined air-supplying/armored air-purifying system in accordance with a first preferred embodiment of the present invention.

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a perspective view of a combined air-supplying/armored air-purifying system 10 in accordance with a first preferred embodiment of the present invention. The combined system 10 includes an SCBA 20 and an armored PAPR 40, both supported by a carrying frame 21, and a mask or facepiece 18. Each of these components will be described in greater detail below.

Figure 2:
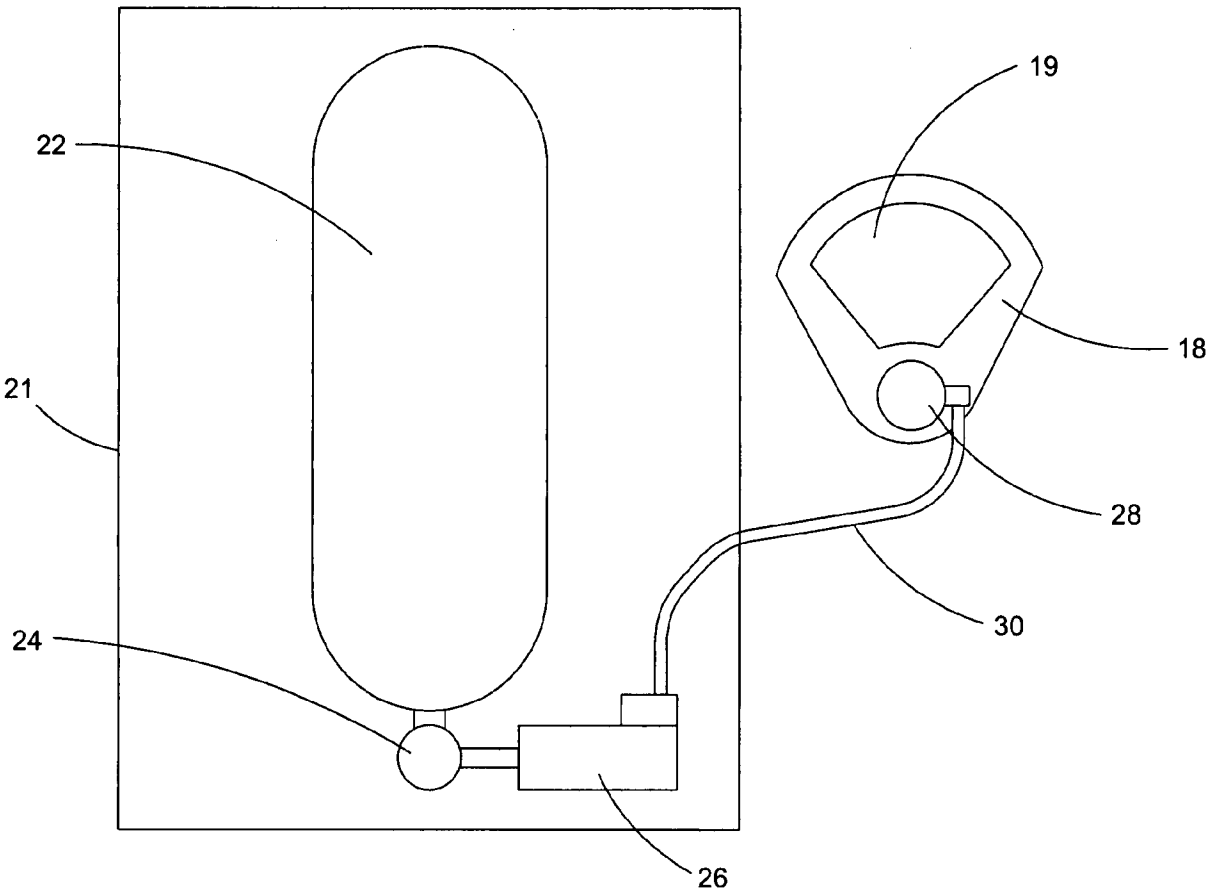
FIG. 2 is a high-level schematic diagram of the SCBA of FIG. 1.

FIG. 2 is a high-level schematic diagram of the SCBA 20 of FIG. 1. The SCBA 20 includes one or more pressure vessel 22, a valve assembly 24, a pressure reducer 26, a high-pressure hose assembly 30 for providing a fluid connection between the outlet of the pressure reducer 26 and the facepiece 18, a second stage pressure reduction assembly or regulator 28 and at least one electronics module 34, shown in FIGS. 1 and 5. The pressure vessel 22, valve assembly 24, pressure reducer 26 and one end of the hose assembly 30 are all carried by the frame 21, which also includes an attachment assembly for connecting the PAPR 40 thereto. The pressure vessel 22 is a pressurized cylinder or tank that provides a supply of breathing gas to the wearer. In one preferred form of the invention the tank 22 may be of a type that initially holds air at a pressure of about 316.4 kg/sq.cm. (4500 p.s.i.g.) or another standard capacity.

Figure 14:
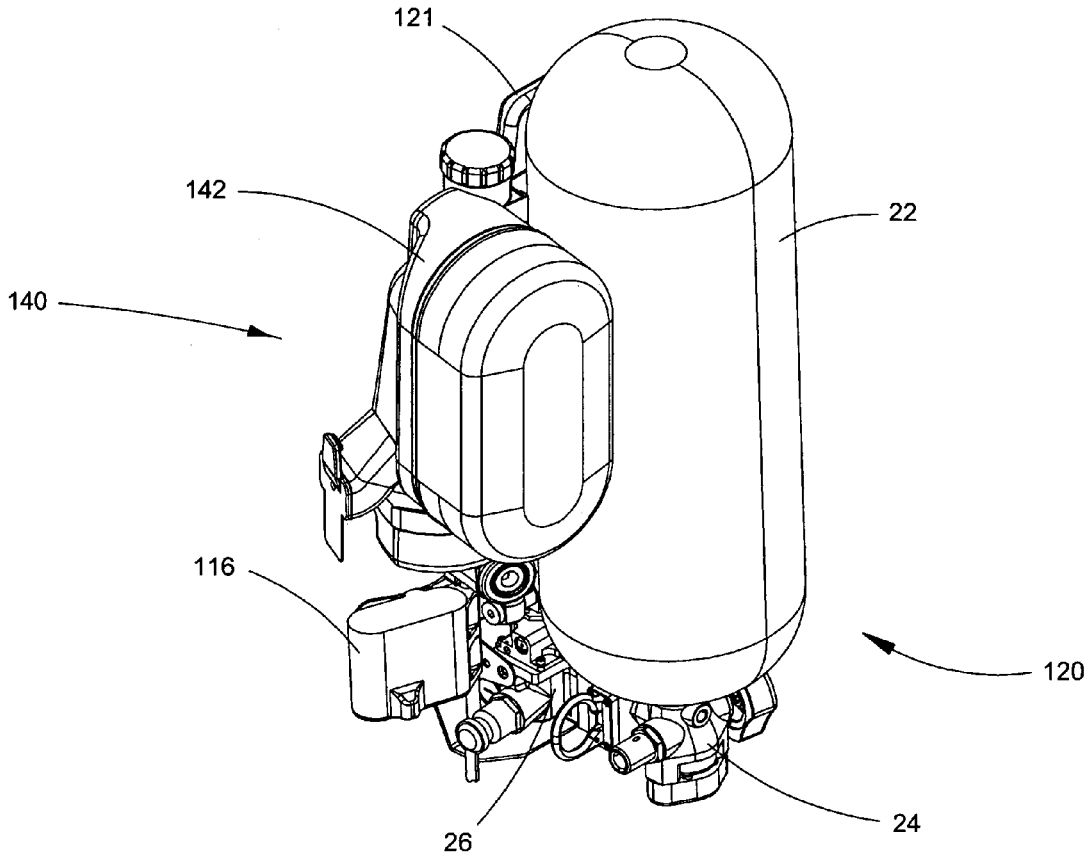
FIG. 14 is a perspective view of an alternative combined air-supplying/armored air-purifying system in accordance with a second preferred embodiment of the present invention.
Figure 15:
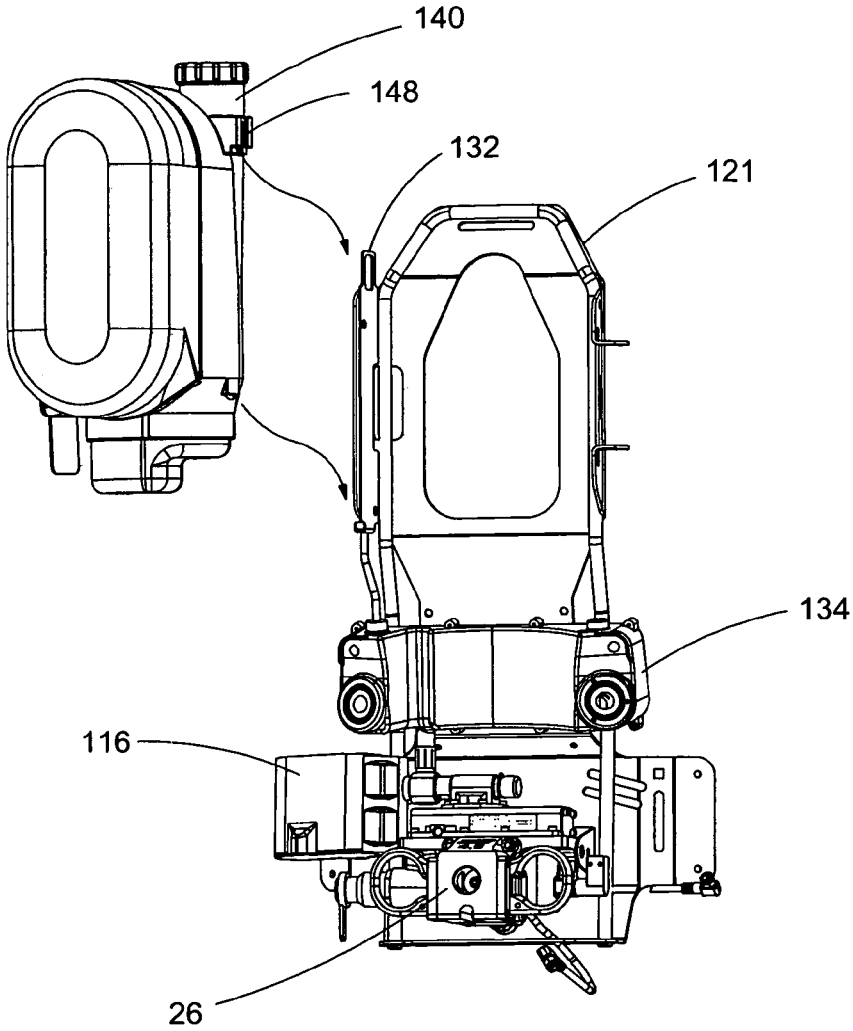
FIG. 15 is a perspective view of the combined system of FIG. 14, showing the PAPR separated from the SCBA.

The first stage pressure reducer 26 is in fluid communication with the valve assembly 24, which is disposed at the outlet of the tank 22. In the illustrated embodiment, the first stage pressure reducer 26 is fluidly connected to the valve assembly 24 by an additional high-pressure hose assembly 31. However, it will be apparent to those of ordinary skill in the art that the first stage pressure reducer 26 may alternatively be connected directly to the valve assembly 24. In a particular alternative embodiment, the first stage pressure reducer 26 and valve assembly 24 may be combined together in a combination quick connect valve and pressure reducer such as the one disclosed in the commonly-assigned U.S. patent application Ser. No. 10/884,784, the entirety of which is incorporated herein by reference. Such a combination valve and pressure reducer is illustrated in FIGS. 14 and 15, described below.

The electronics module 34, which may also be carried by the frame 21, may include a built-in power supply and a variety of controls and connections for interfacing with the pressure reducer 26, the PAPR 40, electrical devices in or on the facepiece 18, and the like. In particular, the electronics module 34 includes a controller that determines whether the SCBA 20 or PAPR 40 is operated at any given time. Specifically, the electronics module 34 may include a user interface for manually activating one or both the SCBA 20 and the PAPR 40 and/or a facility for automatically activating one or both the SCBA 20 and the PAPR 40 under certain conditions. The module 34 may communicate with the PAPR 40 via an electrical, mechanical and/or non-contact interface.

Figure 3:
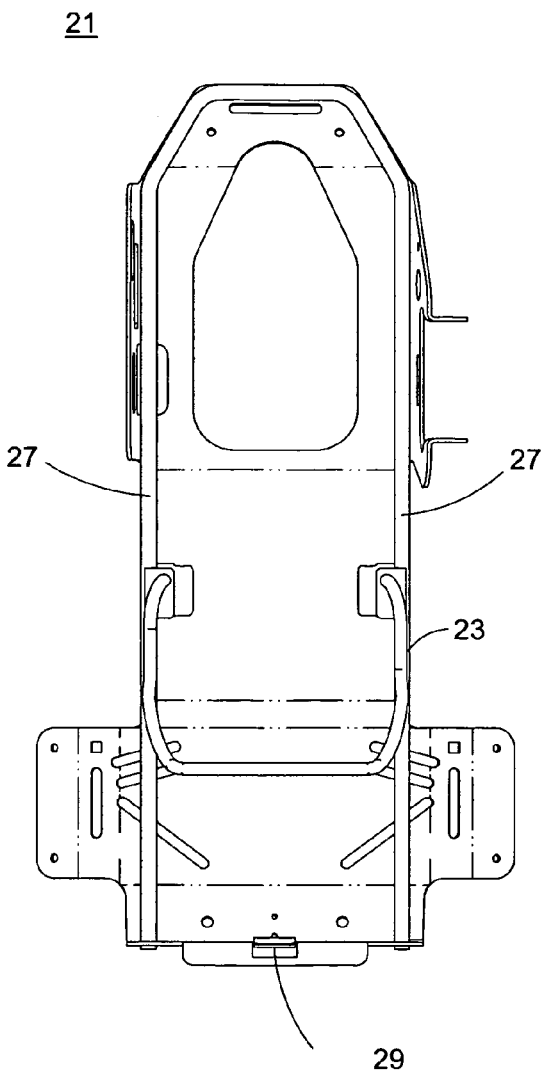
FIG. 3 is a front elevation view of the carrying frame of FIG. 1.
Figure 4:
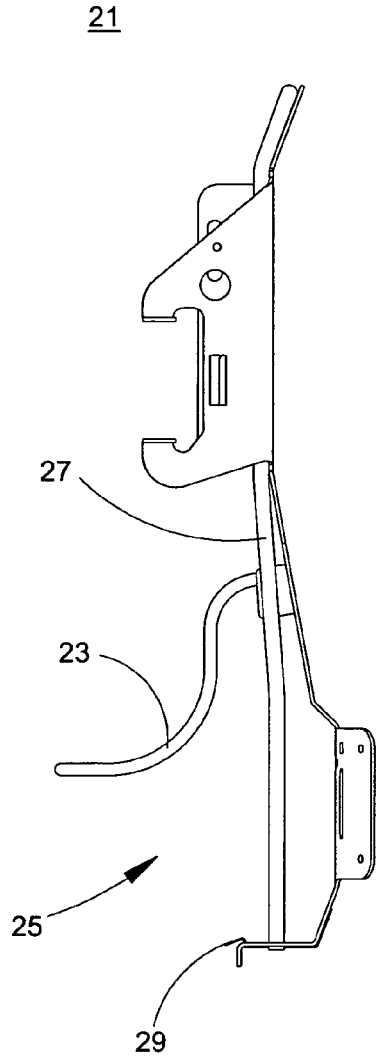
FIG. 4 is a right side elevation view of the carrying frame of FIG. 3.

FIGS. 3 and 4 are front and right side elevation views, respectively, of the carrying frame 21 of FIG. 1. Although a wide variety of frame designs may be utilized that are capable of carrying both the SCBA 20 and the PAPR 40, the frame 21 of FIGS. 3 and 4 is particularly suitable for use with the preferred embodiments of the present invention because, for among other reasons, the frame 21 permits the PAPR 40 to be separated and removed therefrom, as further described hereinbelow. In addition to other conventional elements, the frame 21 includes a wire basket 23 for supporting the tank 22. A recess 25 behind the wire basket 23 accommodates the PAPR 40, as described below.

Figure 5:
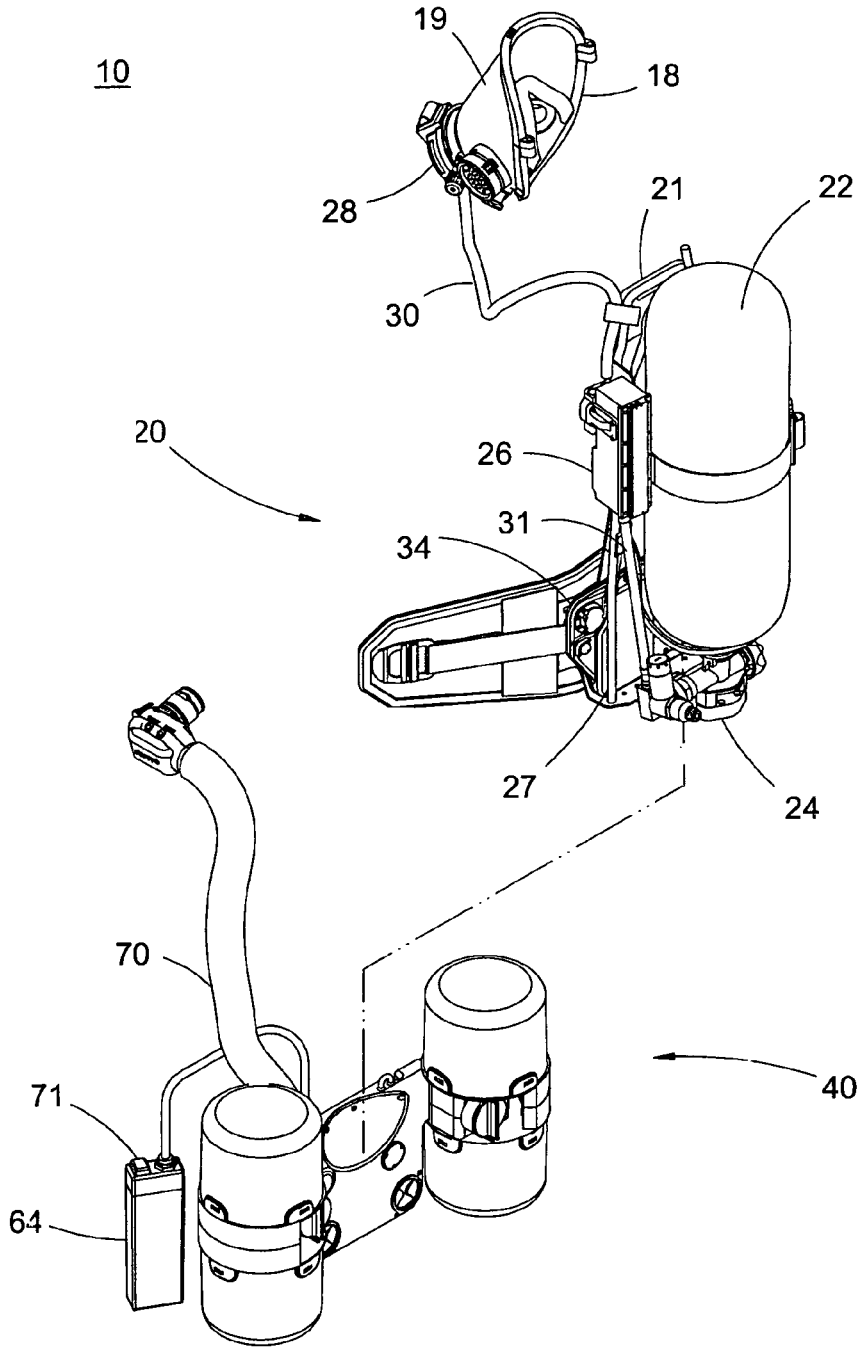
FIGS. 5 and 5A are top front and bottom front perspective views, respectively, of the system of FIG. 1 showing the PAPR detached from the SCBA.
Figure 5A:
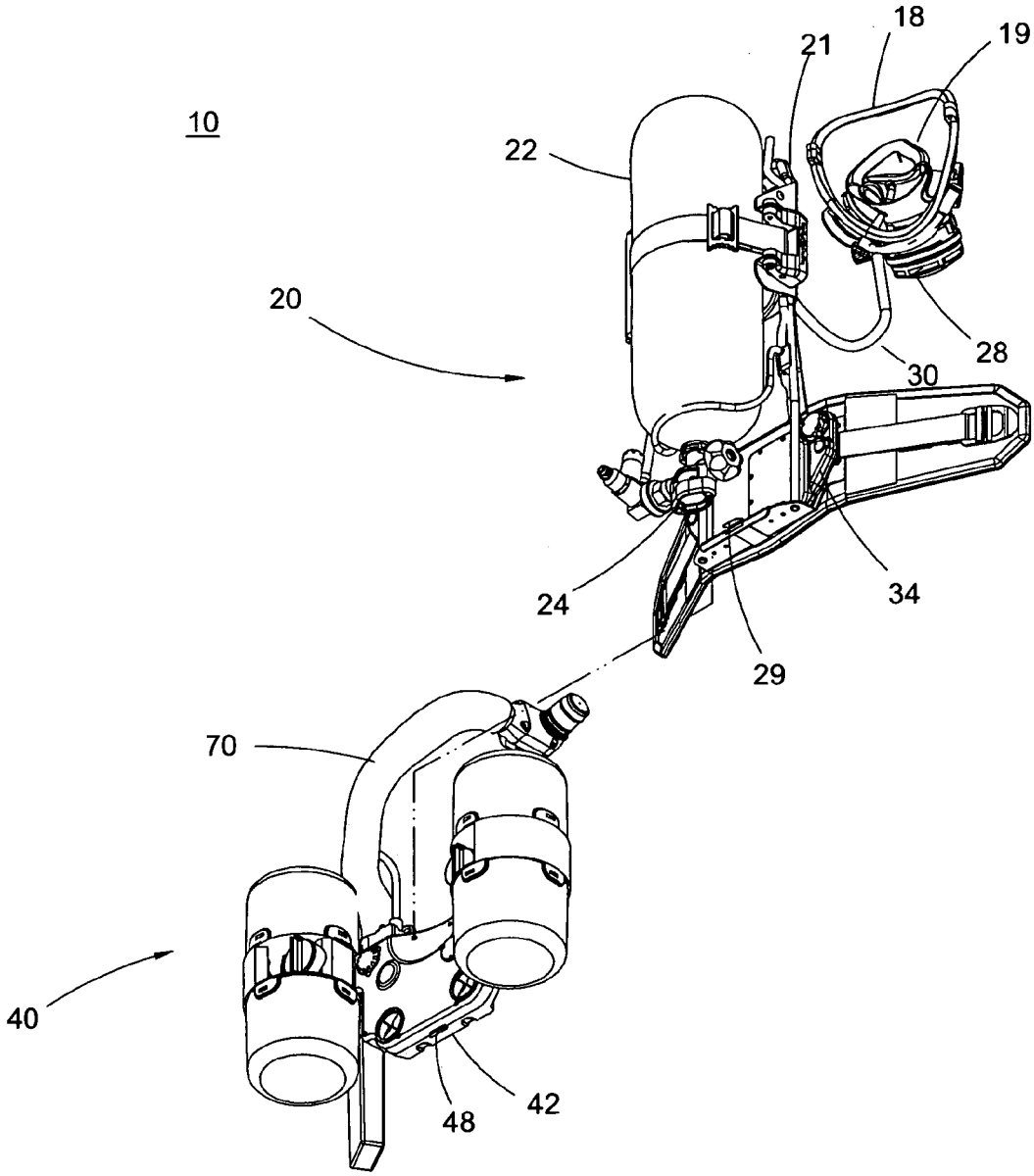
Figure 6:
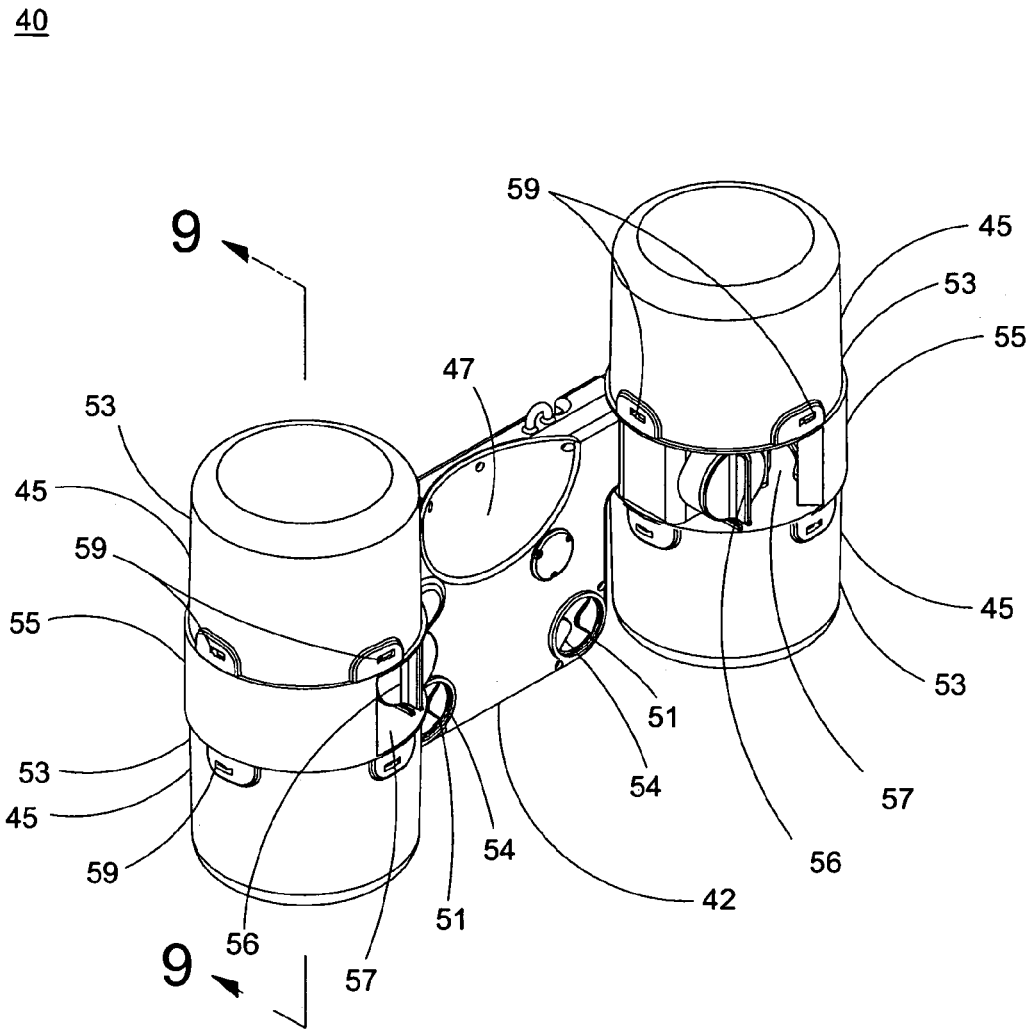
FIGS. 6 and 6A are enlarged top front and bottom front perspective views, respectively, of the PAPR of FIGS. 5 and 5A.
Figure 6A:
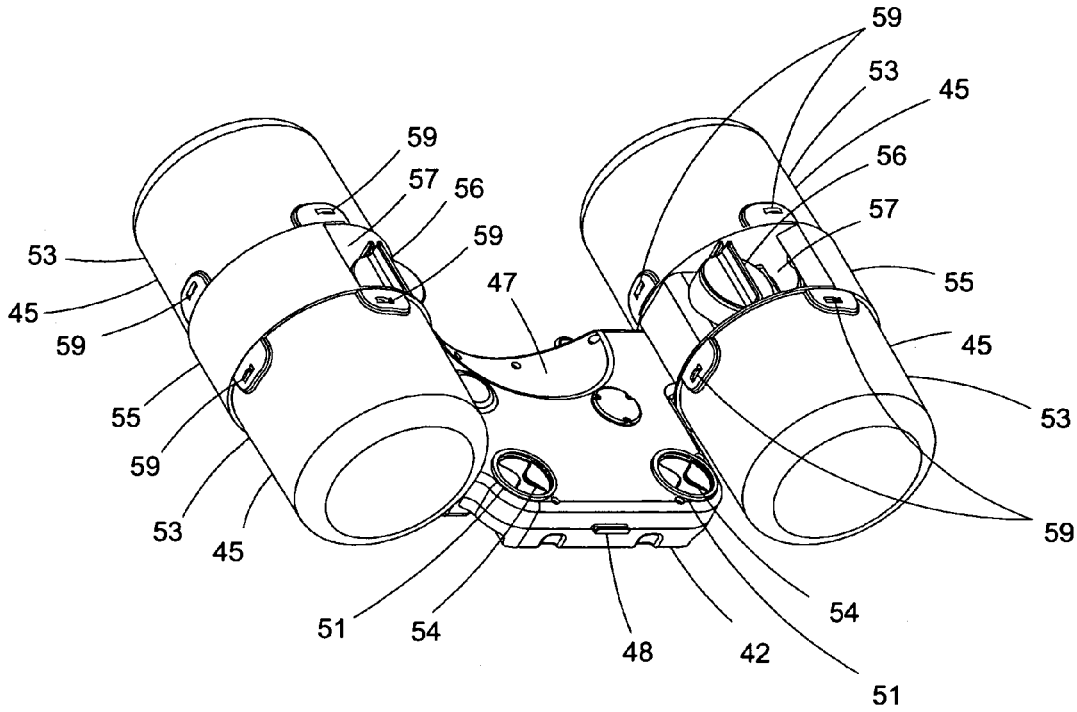
Figure 7:
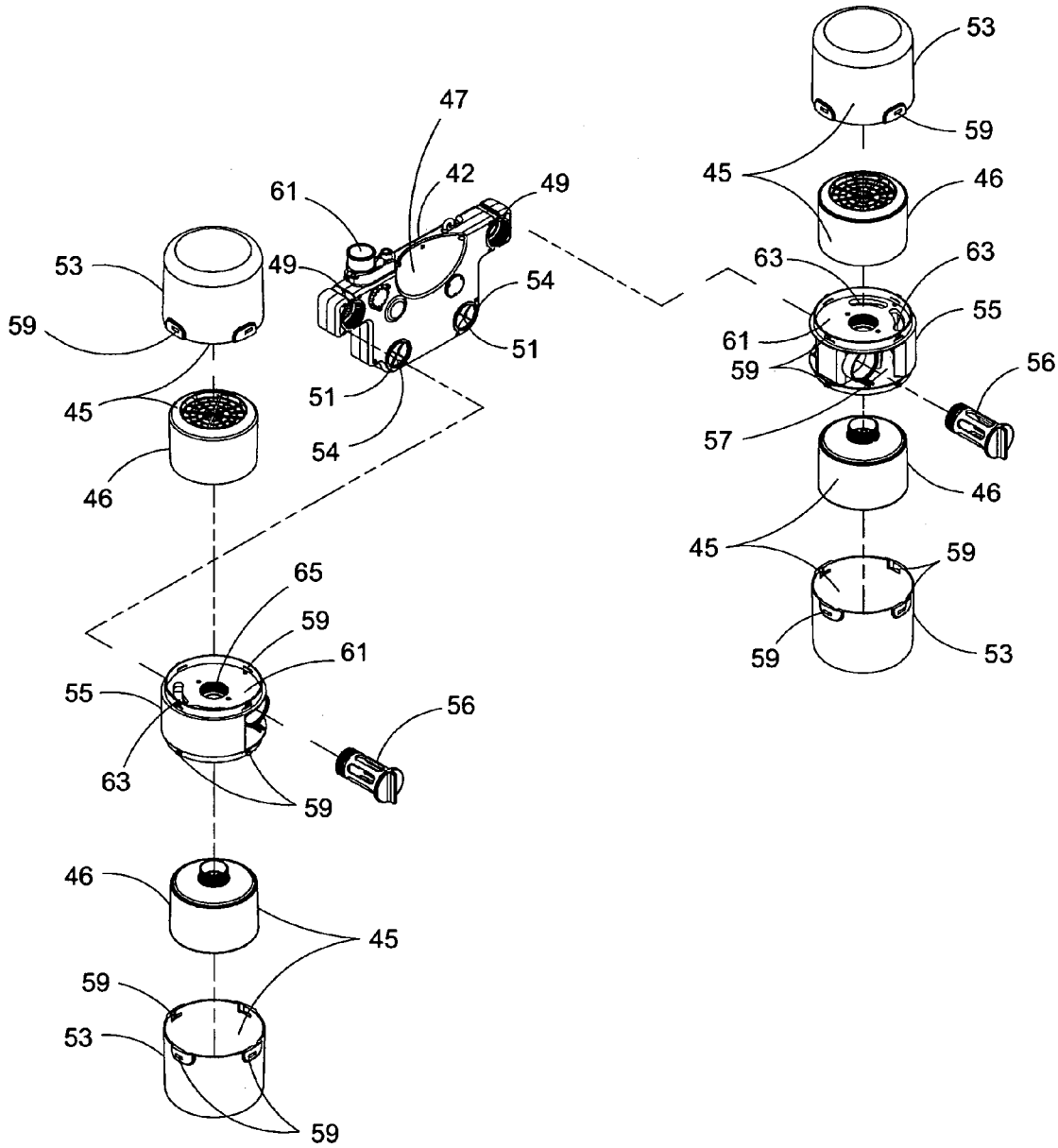
FIG. 7 is an exploded perspective view of the PAPR of FIG. 6.

FIGS. 5 and 5A are perspective views of the system 10 of FIG. 1 showing the PAPR 40 detached from the SCBA 20, while FIGS. 6 and 6A are enlarged perspective views of the PAPR 40 of FIGS. 5 and 5A, and FIG. 7 is an exploded perspective view of the PAPR 40 of FIG. 6. The PAPR 40 includes a housing 42, one or more manifolds 55, a plurality of armored filters 45, a motor (not shown), a battery 64 for the motor, a blower 52 (seen schematically in FIG. 13), a low-pressure hose assembly 70 for providing a fluid connection between the outlet of the PAPR 40 and the facepiece 18, and a controller (not shown). Each of these components is described in greater detail below.

The main body of the PAPR 40 is the PAPR housing 42, which encloses the motor (not shown), the blower 52 and at least part of the controller and provides support for the various other components. The PAPR housing 42 provides the primary structure of the PAPR 40 and includes one or more ports 49, 51 for filter canisters 46 as well as an attachment assembly for connecting the PAPR 40 to the frame 21 carrying the SCBA 20. As used herein, the term "filter canister" shall refer to any discrete device used to adsorb, filter or detoxify airborne poisons, irritants, particulates, or the like, regardless of the physical shape of such device. The particular type of filter canisters 46 to be used will be dependent on the environment in which they are to be used as well as a wide variety of other factors apparent to those of ordinary skill in the art, but one filter canister suitable for use in at least some implementations of the PAPR 40 of the present invention is the Enforcement filter available from Scott Health & Safety of Monroe, N.C. As shown, the housing 42 is T-shaped in order to provide sufficient surface area to permit multiple filter canisters 46 to be mounted, but it will be apparent that other shapes and configurations are likewise possible. The shape may be further modified with the inclusion of a recess 47 or other features in order to permit the housing 42 to fit snugly against the SCBA's tank 22 or other components of the SCBA 20 or the carrying frame 21.

In the particular embodiment of the PAPR housing 42 illustrated in FIG. 5 et al., four ports 49, 51 are provided, including two upper ports 49 and two lower ports 51, each oriented in a forward-facing direction for purposes that will become apparent hereinbelow. However, it will be apparent that other numbers, locations, combinations and orientations of ports 49, 51 may likewise be utilized without departing from the scope of the present invention. Each port 49, 51 is preferably of a standard size and includes a coupling mechanism, thereby permitting various accessories to be attached thereto. One port configuration suitable for use in the preferred embodiments of the present invention is a standard DIN 40 mm connection having a threaded female fitting for receiving various canister filters, covers, intake devices, or the like.

Figure 8:
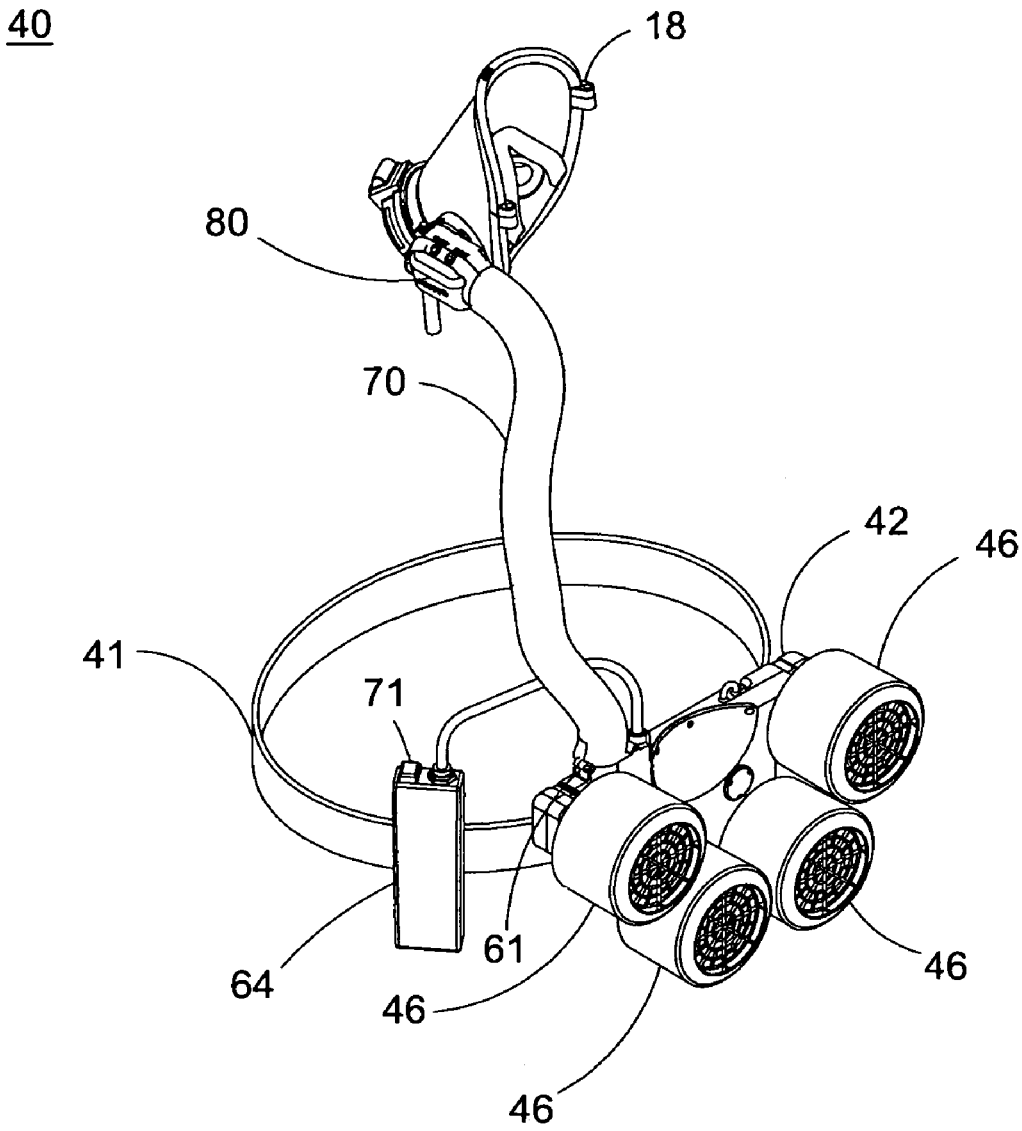
FIG. 8 is a front perspective view of an alternative configuration of the PAPR of FIG. 6, shown with the facepiece of FIG. 1 connected thereto.

Each port 49, 51 may be utilized in a variety of ways. For example, FIG. 8 is a perspective view of an alternative configuration of the PAPR 40 of FIG. 6, shown with the facepiece 18 of FIG. 1 connected thereto. In this configuration, filter canisters 46 may be attached directly to both the upper and lower ports 49, 51 of the PAPR housing 42. All four ports 49, 51 are thus utilized. Each filter canister 46 is assumed to have a threaded male fitting designed to couple with the female fitting of the respective port 49, 51. In this configuration, ambient air may drawn directly through the various filter canisters 46 and into the PAPR 40 itself.

On the other hand, in the primary preferred embodiment shown in FIGS. 5-7, a manifold 55 is mounted to each of the upper ports 49 via an intake tube 56, while the two lower ports 51 are plugged with a removable cap 54. Each intake tube 56 has a capped end, an open end and sides having large perforations or openings therein. The external surfaces of the open end are threaded so as to permit coupling of the tube 56 to one of the upper ports 49 of the housing 42. By inserting the tube 56 through generally cylindrical openings in a manifold 55 and screwing the threaded end of the tube 56 into the port 49, the manifold 55 may be attached to the PAPR housing 42. As described in greater detail below, each manifold is adapted to support a plurality of filter canisters 46. This arrangement effectively permits more than one filter canister 46 to be coupled to each of the upper ports 49, thereby providing several advantages as discussed further hereinbelow. It will also be apparent that in a still further alternative arrangement, some of the same advantages may be accomplished by replacing each manifold with a simple T-, Y- or other adapter (not shown), equipped with a single threaded male fitting and two or more threaded female fittings, whereby the male fitting may be coupled to any of the ports 49, 51 and a filter canister 46 may be coupled to each of the various female fittings.

In addition to the functional flexibility provided by the various ports 49, 51 provided by the PAPR housing 42, the capability of the PAPR housing 42 to be used in different configurations provides a manufacturability advantage. More particularly, a single part (the PAPR housing 42) may be manufactured that may be utilized by users in multiple ways. The PAPR housing 42 may even be supplied with caps 54 permanently affixed to any of the ports 49, 51, thus creating multiple configurations without requiring a different part to be manufactured and stocked separately.

As described below, the entire assembly 40 may be separated from the SCBA 20 and carried by the user around his waist via a belt 41, as shown in FIG. 8, or on his back or over his shoulder using a simple conventional shoulder strap or harness (not shown) or any other suitable apparatus. The PAPR housing 42, which is preferably an injection-molded design made from a glass-reinforced nylon material, may be removably mounted on the carrying frame 21 by mating their respective attachment assemblies together.

Any suitable connection means may be used for this purpose, but a particularly useful means is perhaps best shown in FIGS. 5 and 6. The attachment assembly 32 on the carrying frame 21 includes two exposed rods 27, disposed near the edge thereof, a top bracket (not shown) and a bottom bracket 29, while the attachment assembly of the PAPR housing 42 includes an upper tab (not shown) and a lower latch 48. The rods 27 act as guides for aligning the PAPR housing 42 and also help to support the PAPR housing 42 once it is installed. The bottom bracket 29 of the frame 21 may include a notched lip for releasably connecting with the lower latch 48 of the PAPR housing 42. The top bracket of the frame 21 is adapted to capture the upper tab on the PAPR housing 42 to prevent movement of the PAPR housing 42 away from the frame 21, and also acts as a positive stop to prevent the PAPR housing 42 from moving up and away from the latch 29 on the bottom of the frame 21.

Installing the PAPR is accomplished by sliding the top of the PAPR under the cylinder 22 and along the rods 27 until the upper tab contacts the top bracket of the frame 21. The bottom of the PAPR housing 42 may then be pushed toward the frame 21. When the lower latch 48 contacts and engages the bottom bracket 29, it is automatically locked into place. Removal of the PAPR 40 may then be accomplished by opening the latch 48 and reversing the installation process. Advantageously, the entire installation and removal process may be accomplished without disengaging the tank 22 or any other component of the SCBA 20 from the frame 21, and does not require the use of any special tools.

Figure 9A:
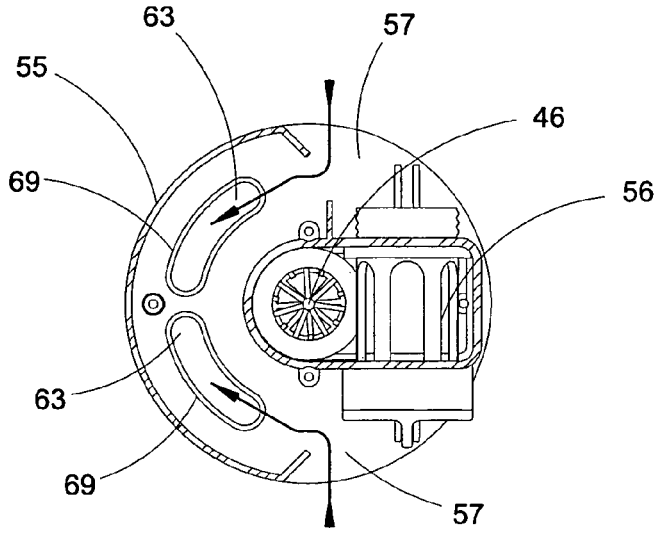
FIG. 9A is a top cross-sectional view of the PAPR of FIG. 9, taken along line 9A-9A.
Figure 9:
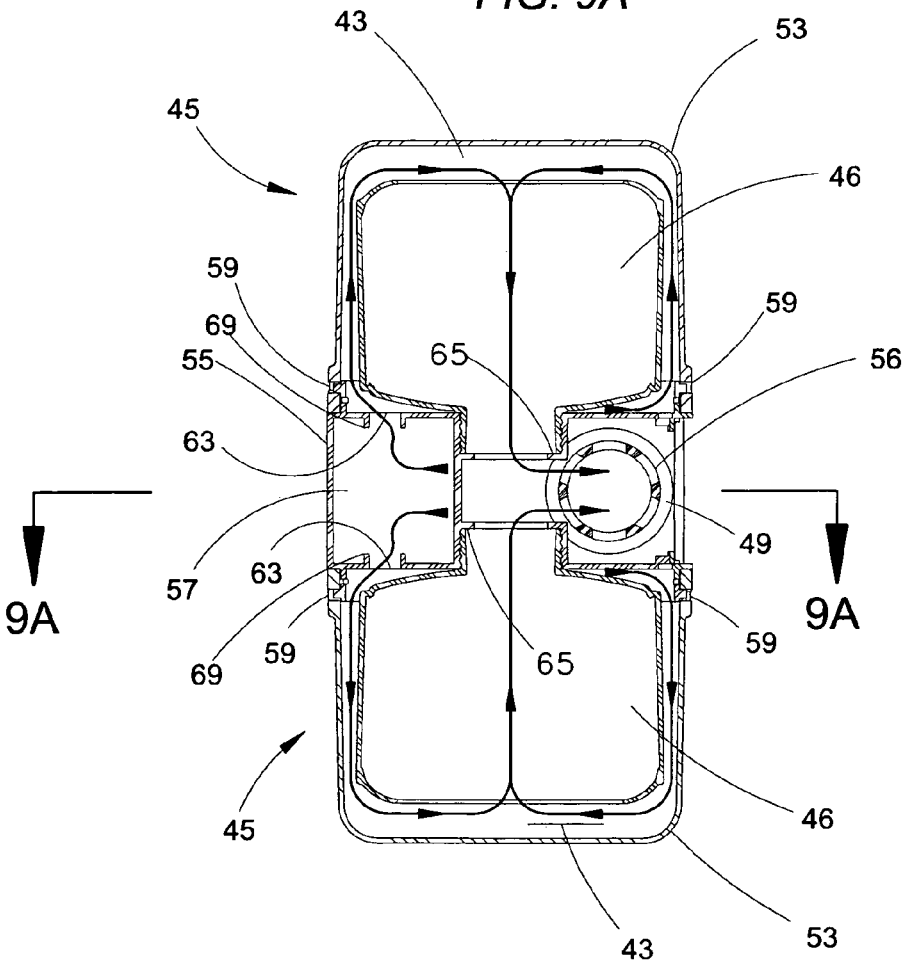
FIG. 9 is a partial front cross-sectional view of the PAPR of FIG. 6, taken along line 9-9.

FIG. 9 is a side cross-sectional view of the PAPR 40 of FIG. 6, taken along line 9-9, and FIG. 9A is a top cross-sectional view of the PAPR of FIG. 9, taken along line 9A-9A. Referring primarily to FIGS. 6, 7, 9 and 9A, the PAPR 40 includes two manifolds 55 and four armored filters 45, with two armored filters 45 attached to each manifold 55. Each armored filter 45 includes a filter canister 46 and a filter cover 53. Together, the filter covers 53 and manifolds 55 form enclosures 43, best illustrated in FIG. 9, that protect the filter canisters 46 from a heat, flame, high humidity or wet environment, in addition to protecting the canisters 46 from direct physical blows. As used herein, the term "enclosure" shall refer to any structure or combination of structures defining a single contiguous enclosed interior, whether or not partitioned into separate compartments within such enclosure, that is substantially separated from an external environment by the enclosure structures but accessed by one or more common inlets. Each filter cover 53 may be attached with latches 59, hinges or other means to hold it securely to the PAPR housing 42. Each cover 53 also includes a seal for the junction between the cover 53 and the manifold 55 to ensure that ambient environment is kept out of the PAPR 40. The preferred embodiment of each filter cover 53 is an injection-molded design made from a glass-reinforced nylon material.

Each manifold 55 includes one or more inlets 57, top and bottom plates 61 and two threaded female couplings 65 for receiving the filter canisters 46. The preferred embodiment of each manifold 55 is an injection-molded design made from a glass-reinforced nylon material. Each inlet 57 provides a pathway for ambient air to pass from the external environment into the body of the manifold 55. Such inlets 57, whose use is only made possible by surrounding the filter canisters 46 in enclosures such as those described and illustrated herein, permit the application of a number of advantageous features, some of which are described hereinbelow. For example, although not illustrated, each inlet 57 may optionally include a valve or the like in order to provide the ability to close off the inlet 57 when the PAPR 40 is not in use. Other advantages will be made apparent below.

As best shown in FIG. 9A, air passes from the inlets 57 toward perforations 63 in the top and bottom plates 61. Next, as shown in FIG. 9, the air passes through the perforations 63 into a space between the outer wall surfaces of the filter canisters 46 and the inner wall surfaces of the filter covers 53. Once the air reaches the intake areas of the respective filters 46, it passes through the filters 46 and exits into a central collection chamber of the manifold 55. Finally, the air passes through the openings in the sides of the intake tube 56 and flows through to the upper ports 49 of the PAPR housing 42 itself.

An additional advantageous feature is illustrated in FIG. 9. It is well known that if the PAPR 40 is carried into a typical environment in which water or other liquids are being used as part of fighting a fire or the like, the PAPR 40 and other parts of the system 10 are likely to be sprayed or otherwise come in contact with such liquids. Similarly, water vapor frequently arises in humid environments such as may be encountered by typical PAPR or SCBA users. As a result, air filters used in such environments are subject to clogs, damage or other performance degradation caused by the water and other fluids interacting with the filters in either liquid or vapor form.

To minimize or prevent such deleterious effects, a raised lip 69, generally referred to hereinafter as a "fluid dam," is disposed around the periphery of each perforation 63 in the top and bottom plates 61. Each fluid dam 69 is arranged such that it extends vertically into the interior of the manifold 55. The purpose of the fluid dams 69 is to prevent water and other liquids that may collect near the inlets 57 of the manifolds 55 from draining through the perforations 63 in the top and bottom plates 61. When a manifold 55 is oriented as shown in FIG. 9, one fluid dam 69 extends upward from the lower of the two plates 61. Water and other liquids entering the inlets 57 tends to collect in the chamber between the inlets 57 and the perforations 63. Similar, water vapor entering the inlets begins condensing in the same chamber. Together, gravity causes these fluids tend to fill the bottom of the chamber. However, the fluid dam 69 effectively raises the entrance to the perforations 63 above the floor of the chamber, which in the orientation shown is formed by the bottom plate 61. Because the entrance to the perforations 63 is thus effectively above the standing level of fluids in the chamber, the collected fluids are thus trapped, preventing them from ever reaching the filter canisters 46 and causing damage thereto.

The second fluid dam 69, which extends downward from the upper of the two plates 61, is provided for at least two reasons. Although in the orientation shown in FIG. 9 this upper fluid dam 69 serves no direct purpose, it will be apparent that firefighters and other personnel that make use of PAPR's, including the PAPR 40 of the present invention, are likely to shift their PAPR's into a wide variety of orientations as they crawl, clamber and otherwise maneuver themselves and their equipment through an emergency scene. In at least some of these orientations, the PAPR 40 is likely to be reoriented such that the fluid dam 69 shown in the upper location in FIG. 9 becomes lower than the other fluid dam 69, in which case the fluid dam 69 must have the same capabilities as described previously. Furthermore, by making the manifold 55 symmetrical, the manifold 55 may be installed without regard to which fluid dam 69 is the upper one and which is the lower one.

It will also be noted that by positioning the perforations 63 some distance away from the walls of the manifold 55, fluids collected at the bottom of the chamber are unlikely to spill into the perforations 63 in the top plate 61 if the PAPR housing 42, and hence the manifold 55, were to suddenly be inverted. Instead, the collected fluids are likely to flow toward one of the walls and then along the wall before collecting on the opposite plate 61, which at that point has become the floor of the chamber. In this situation, the fluids will again be prevented from flowing into the perforations 61 by the opposite fluid dam 69.

By effectively enclosing the two filter canisters 46 in a single compartment or enclosure 43 with a limited number of inlets 57, greater uniformity is promoted in the filtering process and greater control is provided over the distribution of ambient air to the filters 46. The manifold 55 acts as an accumulator, and the symmetrical arrangement of the filter canisters 46 and the air path used to distribute air thereto ensures that each of the filter canisters 46 has the same amount of air flow. This construction also permits the inclusion of the fluid dams 69 to prevent water and other liquids from seeping into the filter canisters 46; themselves, as described above.

The blower 52 is arranged in the fluid communication path between the filter enclosures 43 and the facepiece 18, and is preferably interposed between the outlet of the manifolds 55 and the inlet end of the PAPR hose assembly 70. The blower 52 functions to pull air from the filter enclosures 43 through the canisters 46, then through the manifolds 55 into the PAPR housing 42 and the inlet of the blower 52, and finally to pump it through the hose assembly 70 to the interior of the facepiece 18. The blower 52 may be an electronically-controlled centrifugal fan driven by the motor.

Figure 10:
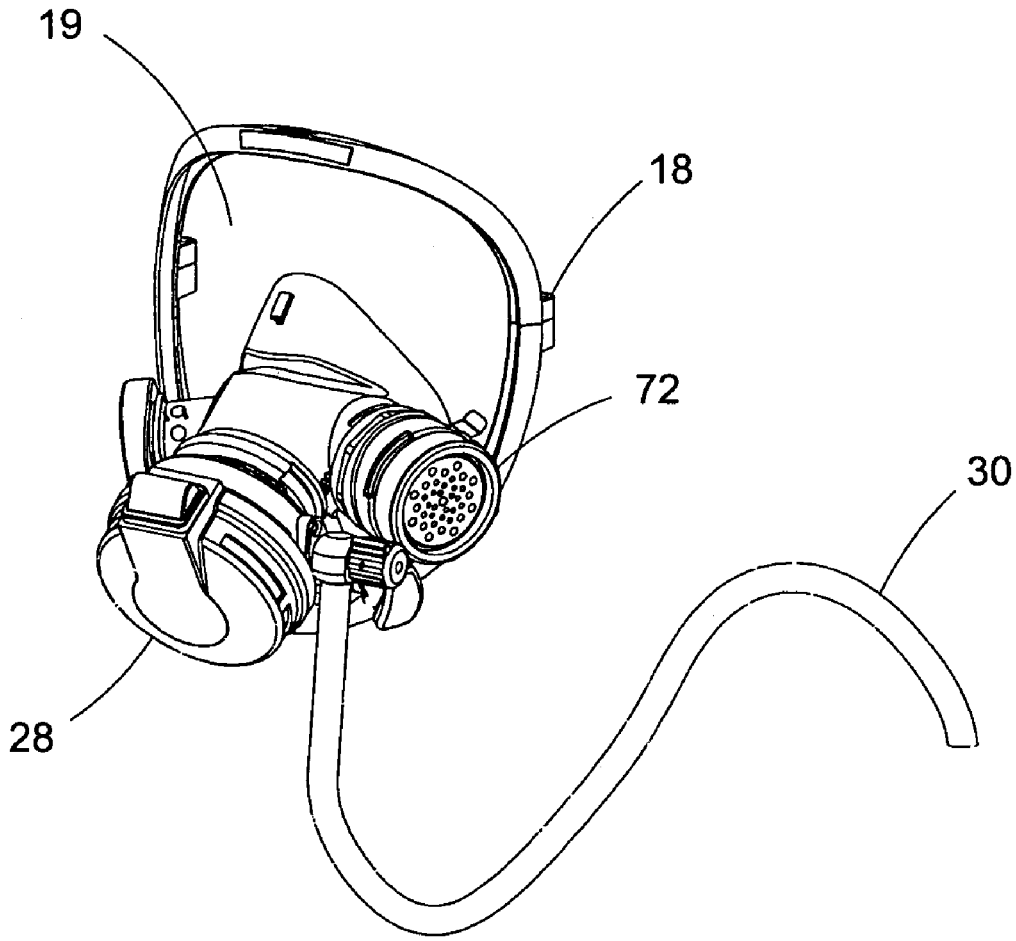
FIG. 10 is a front perspective view of the facepiece of FIG. 1, shown with the SCBA hose attached thereto.

FIG. 10 is a front perspective view of the facepiece 18 of FIG. 1, shown with the SCBA hose assembly 30 attached thereto. The facepiece 18 covers the wearer's nose and mouth in airtight connection, and preferably covers the wearer's eyes with a transparent shield 19 for external viewing. The SCBA hose assembly 30 is interposed between the pressure reducer 26 and the facepiece 18 via the second stage regulator 28 of the SCBA 20. This breathing regulator 28, which is preferably disposed on the facepiece 18, includes a regulator chamber (not shown) in fluid communication with the hose assembly 30. The second stage regulator 28 may be any one of a number of conventional or novel types, including demand type regulators or positive pressure type regulators. In one embodiment preferred, among other reasons, for its adaptability to current products, the regulator 28 remains in place on the facepiece 18 whether or not the SCBA 20 is in use or not. When the SCBA 20 is not in use, a one-way exhalation port on this regulator 28 continues to serve as the exhaust point for exhaled breath when the user is breathing air supplied by the PAPR 40. In addition, the side of the facepiece 18 is equipped with a fitting 72 serving as a connection point for the convoluted PAPR hose 70 that attaches the PAPR 40 to the facepiece 18. Preferably, the fitting 72 is a quarter-turn fitting to provide ease of connection, but other types of fittings, such as a standard 40 mm screw-in connection, will be apparent to those of ordinary skill in the art.

Figure 11:
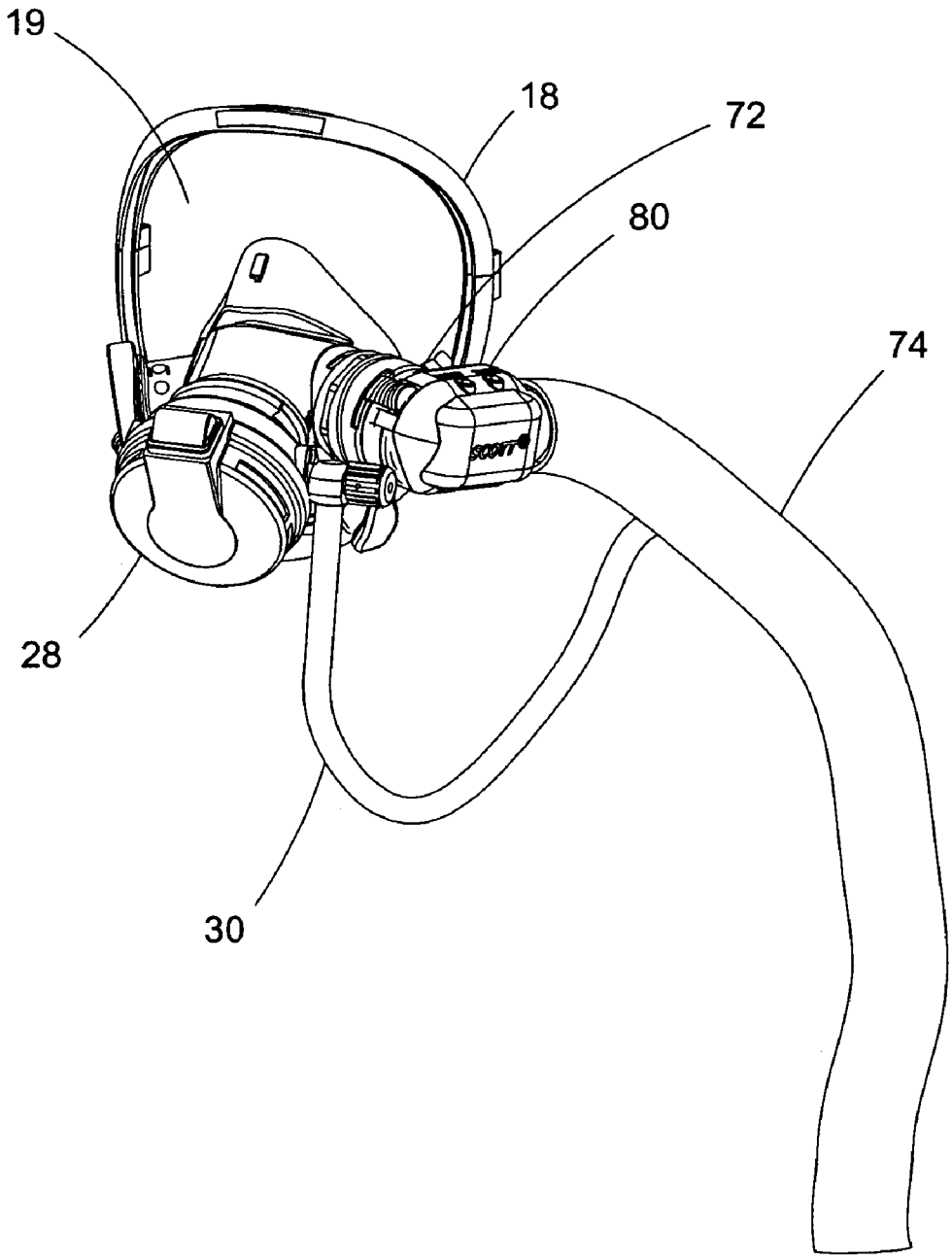
FIG. 11 is a front perspective view of the facepiece of FIG. 10, shown with both the SCBA and PAPR hoses attached thereto.

FIG. 11 is a front perspective view of the facepiece 18 of FIG. 10, shown with both the SCBA and PAPR hose assemblies 30, 70 attached thereto. The PAPR hose assembly 70 includes a low-pressure convoluted hose 74 and a hose adapter 80. In a preferred embodiment, the convoluted hose 74 is constructed of a butyl rubber polymer selected for chemical resistance and high heat and flame performance.

Figure 12:
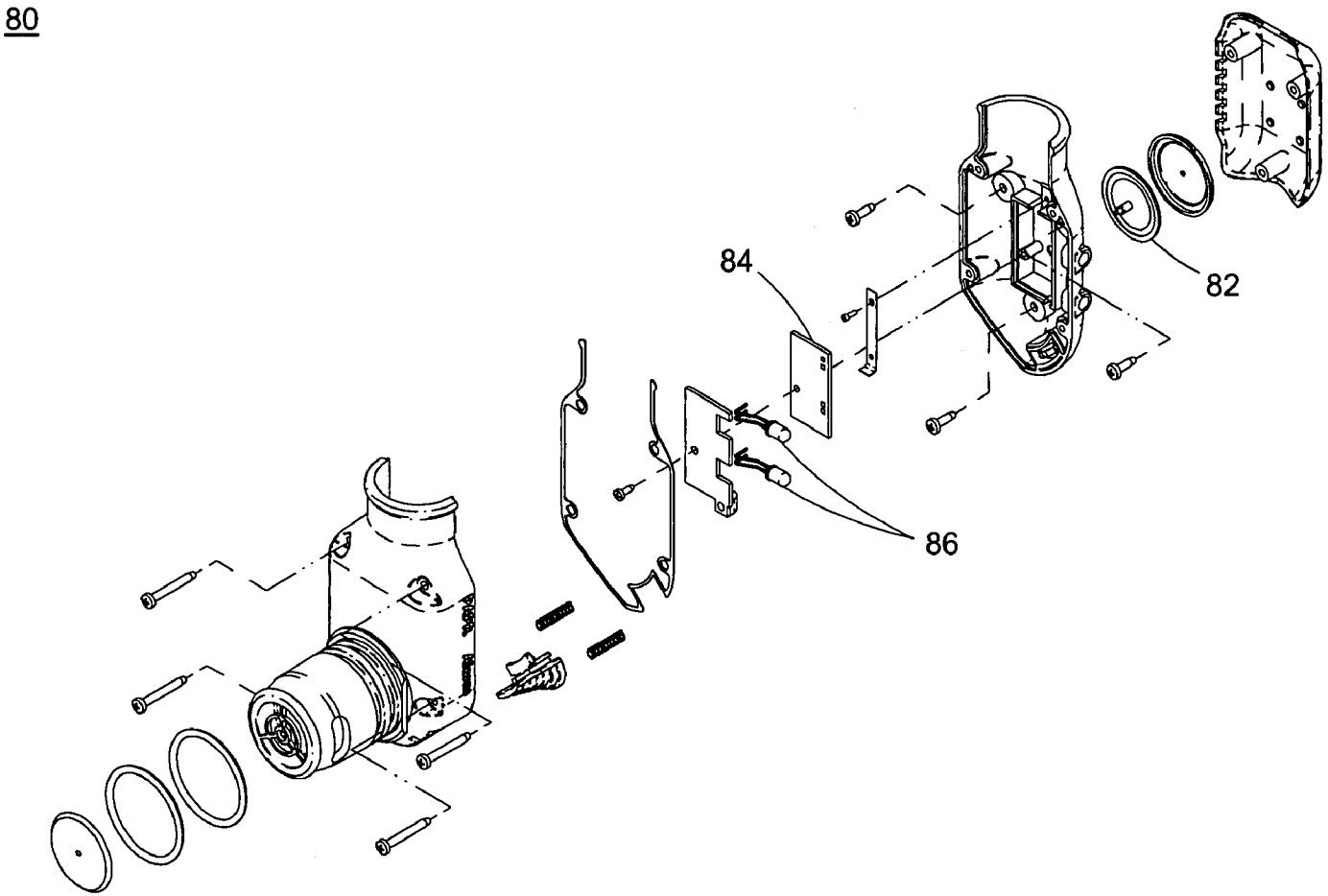
FIG. 12 is an exploded perspective view of the hose adapter of FIG. 11.

FIG. 12 is an exploded perspective view of the hose adapter 80 of FIG. 11. The adapter 80 includes a one-way valve 82 and a pressure transducer 84. With the valve 82 open, the pressure transducer 84 measures mask pressure. When the wearer exhales, pressure in the mask rises. The transducer 84 recognizes this rise and closes the valve 82 to prevent exhaled air from reentering the PAPR hose 74. With a constant-speed motor, the incoming air that has been filtered in the PAPR 40 is then stalled in the blower 52. When the wearer inhales again, the pressure in the mask drops and the valve 82 opens, allowing the wearer to inhale air from the PAPR 40 once again. This process is repeated with every breath the wearer takes.

In another embodiment (not illustrated), the transducer 84 may alternatively be used to control an operating parameter of the motor, the blower 52, or both, in order to accomplish a similar function. For example, when the pressure rises, the blower fan could be stopped, and when the pressure drops, the blower fan could be restarted.

The hose adapter 80 also preferably includes at least two visual status indicators 86, which may be LED's or the like. A first LED 86 provides a visual indication as to whether the PAPR 40 is operating or not; i.e., if the LED 86 is lit, then the PAPR 40 is currently powered on. A second LED 86 provides a visual indication as to whether the PAPR 40 is an alarm state or not. For example, the second LED 86 may be lit if the PAPR's battery 64 is low, if the flow of air exiting the blower 52 is lower than a predetermined threshold, or if some other alarm or error condition exists. Appropriate circuitry may be provided to carry out each of these functions, and it will be apparent that particular alarm conditions may be further distinguished visually through the use of additional LED's, multistate visual indicators, or the like.

Operation of the PAPR 40 is controlled by the controller, which includes a user interface and the electrical assembly for the motor. The user interface is preferably disposed in a separate unit that may be carried in a location convenient for the user to see and manipulate, such as on a pendant arranged to hang over the user's shoulder and down his chest. The user interface includes a simple on/off switch 71 for manually activating and deactivating the PAPR 40 as well as a battery status indicator. For ease of use and ease of connection, the battery 64 for the motor is preferably located adjacent the user interface, also carried on the pendant.

Figure 13:
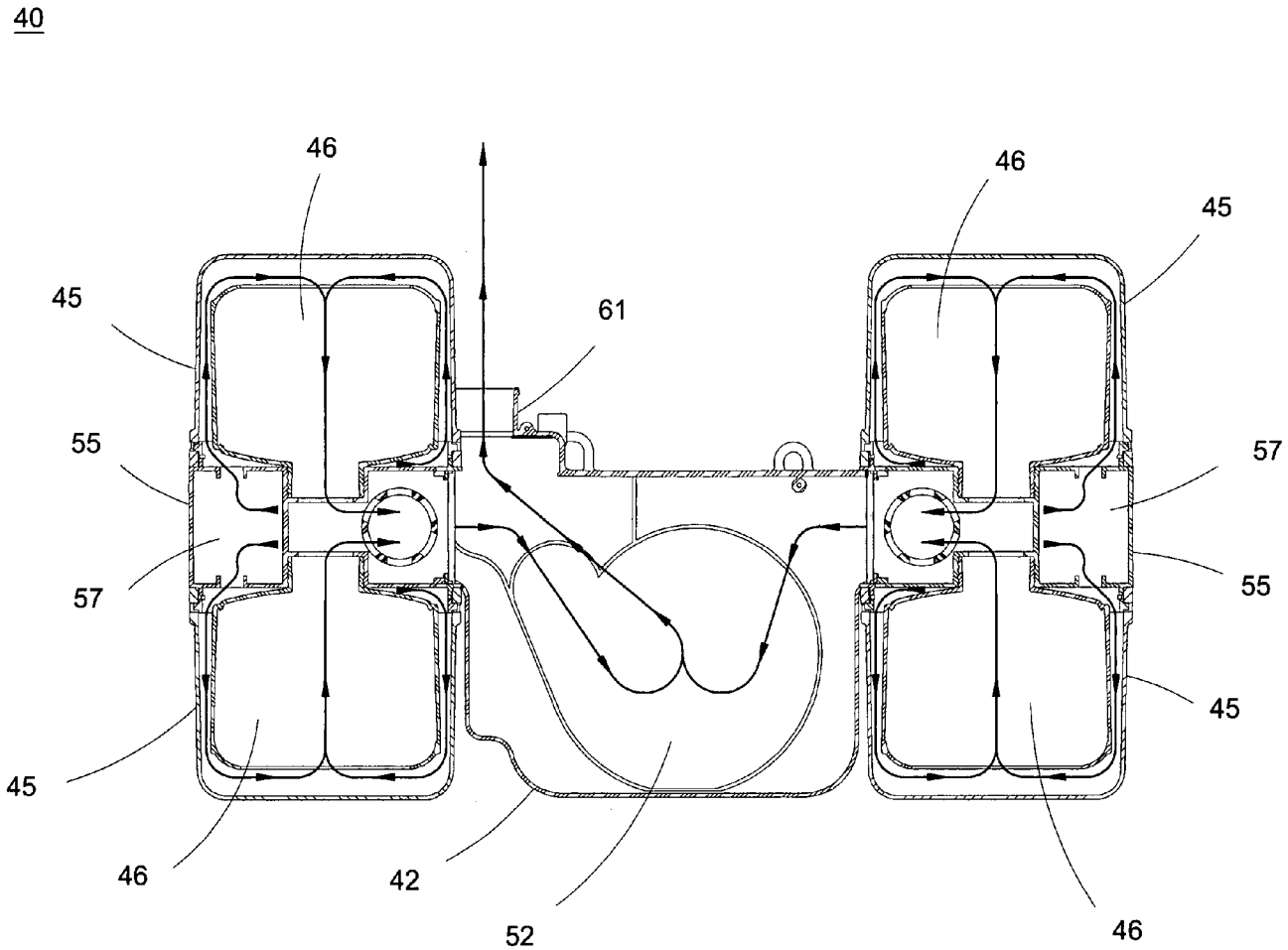
FIG. 13 is a front cross-sectional view of the PAPR of FIG. 6, taken along line 9-9, showing the flow of air therethrough.

FIG. 13 is a schematic view of the PAPR 40 of FIG. 5 showing the flow of air therethrough. As described previously, ambient air enters the PAPR 40 via the inlets 57 and winds around within the armored filters 45 to the intakes for the respective filter canisters 46. Air from each pair of filter canisters 46 is collected in the central collection chamber for each manifold 55 and directed into the PAPR housing 42 itself. In the PAPR housing 42, the air from the respective manifolds is guided through the blower 52 and from there through an outlet 67 connecting to the convoluted hose 70.

Because the SCBA 20 and the PAPR 40 may be joined or separated easily using the means illustrated in FIG. 5 (or any suitable alternative means), the user is allowed to choose which type of respiratory protection is required such that the PAPR 40 may be used without the SCBA 20, the SCBA 20 may be used without the PAPR 40, or the two apparatuses 20, 40 may used in conjunction with each other, simply by attaching or removing the PAPR 40 from the SCBA 20 as desired. If the user chooses, he can begin using the PAPR 40, and then if necessary, attach the PAPR 40 to the SCBA 20 and then selectively switch back and forth between the SCBA 20 and PAPR 40 as the situation dictates. Because the facepiece 18 is used by each apparatus 20, 40 to provide air to the user, the user is able to maintain the facepiece 18 in its place on his face, and is never directly exposed to ambient air, even while switching back and forth between the PAPR 40 and the SCBA 20. This ability to join and separate the two breathing systems 20, 40, while maintaining respiratory protection throughout, provides the user with greater range of choices when operating in a contaminated environment.

In one example of a typical operational scenario, a user carries only the PAPR 40 using the shoulder strap or waist belt 41 described earlier. The PAPR housing 42, filter canisters 46 and blower 52 are thus carried on the user's back, at his side or the like, with such components thus being physically separated from the facepiece 18 but connected thereto via the hose assembly 70. The user may or may not use the PAPR 40 to breathe, depending on the environment encountered or that he expects to encounter. For example, a soldier concerned about possible attack via airborne poison or the like may carry the PAPR 40 without using it until necessary, or if such an attack is imminent, he may don and use the PAPR 40 before the attack occurs. Corresponding scenarios may be envisioned for firefighters and other personnel as well. The PAPR 40 gives the user the ability to breathe filtered air in environments in which the air is otherwise unbreathable, with the type of filter canisters 46 used in the PAPR 40 being dependent on the type of poison, irritant, particulate, or the like that is expected or present.

In some situations, however, air filtered by the PAPR 40 may no longer be safe to breathe, for a variety of reasons. At such times, it may be necessary to switch from PAPR use to SCBA use. Assuming the above-described situation in which the user carries only the PAPR 40, the user first locates a corresponding SCBA 20 of the type described herein. Without interrupting the flow of breathable air to the user, the user may remove the PAPR 40 from his back, shoulder or waist, mount and secure the PAPR 40 on the carrying frame 21, and then don the entire system 10, carrying it on his back. At any time during this process, the user may switch from PAPR use to SCBA use, all without interrupting the flow of breathable air. Similarly, once it is safe to breathe filtered air, and the air supply provided by the SCBA 20 is no longer necessary, or has been exhausted, the user may remove the system 10 from his back, remove the PAPR 40 from the carrying frame 21, discard the SCBA 20, and again don the PAPR 40, once again without interrupting the flow of breathable air.

When separating and joining the SCBA 20 and PAPR 40, it is often important that the user only have a single respirator operating at any given time. This prevents the unnecessary exhaustion of the SCBA tank 22 if only the PAPR 40 is required, and also prevents the PAPR 40 from being used accidentally when the capabilities of the SCBA 20 are required. To ensure that only one respirator is operating at any given time, the system 10 preferably employs means for coordinating the operation of the PAPR 40 with that of the SCBA 20. When the PAPR 40 is not attached to the SCBA 20, the operation of the PAPR 40 is similar to that of a typical PAPR.

On the other hand, when the PAPR 40 is attached to the SCBA 20, the PAPR 40 is subjected to the control of the electronics module 34 of the SCBA 20. If the user has elected to use the PAPR 40 for respiratory function the SCBA 20 does not restrict the PAPR 40 operation. However, if the user elects to switch to the SCBA 20 for respiratory protection, features are preferably provided to ensure safe, efficient and integrated operation of the PAPR 40 in conjunction with the SCBA 20. First, a safety switch is preferably provided to ensure that the PAPR 40 has been successfully connected to the SCBA 20. One way to accomplish this is with a mechanical switch (not shown) indicating that the PAPR housing 42 has been successfully docked (mounted or attached in a mechanically stable state) in place in the carrying frame 21 for the SCBA 20. One type of switch suitable for use in the preferred embodiments of the present invention is a magnetic reed switch. Preferably, a user should be prevented from switching air sources from the PAPR 40 to the SCBA 20 if the output of this switch indicates that the PAPR 40 has not been connected to an SCBA 20.

If the PAPR 40 is successfully docked with the SCBA 20, then an additional control mechanism, which is preferably an automatic mechanical or electrical sensor, may be utilized to turn the PAPR blower 52 off. One suitable sensor involves the use of a non-contact magnetic piston (not shown) within the SCBA electronics module 34. With this sensor, opening the cylinder valve assembly 24 to energize the SCBA 20 causes the piston to move due to the cylinder pressure. The piston is positioned such that its movement interacts with a magnetic switch within the PAPR 40, thereby turning the PAPR blower 52 off. In an alternative sensor, a pressure transducer (not shown) may sense the elevated pressure created in the air supply system of the SCBA 20 when a full or partially-full SCBA tank 22 has been opened. The output of the pressure transducer may be received by the electronics module 34 of the SCBA 20 and then relayed to the PAPR blower 52, thereby turning it off. Of course, if the PAPR 40 has not been successfully docked with the SCBA 20, then the safety switch described previously prevents the PAPR 40 from being deactivated in favor of the SCBA 20.

If the user then elects to switch back to the PAPR 40 for respiratory protection, the electronics module 34 automatically turns the PAPR blower 52 back on. If a pressure transducer is provided as described in the previous paragraph, then the electronics module 34 may also initiate this function automatically when the SCBA tank 22 has been fully or nearly depleted. Such a function may be triggered when the pressure transducer recognizes that the pressure in the air supply system of the SCBA 20 has dropped below a predetermined threshold, thereby indicating that either the user has closed the cylinder valve assembly 24, thereby shutting off the SCBA 20, or that the tank 22 has run out of air.

Finally, separation of the PAPR 40 from the SCBA 20 returns the operation of the PAPR 40 back to that of a typical PAPR 40. In particular, separation of the PAPR 40 from the SCBA 20 deactivates the safety switch described previously, thereby signaling the PAPR 40 that no SCBA 20 is available and automatically activating the PAPR 40 until deactivated manually by the user.

FIG. 14 is a perspective view of an alternative combined air-supplying/armored air-purifying system 110 in accordance with a second preferred embodiment of the present invention. As with the first preferred embodiment, described hereinabove, the alternative combined system 110 includes an SCBA 120 and an armored PAPR 140, both supported by a carrying frame 121, and a mask or facepiece 18. As with the SCBA 20 described previously, the SCBA 120 shown in FIG. 14 includes one or more tank 22, a valve assembly 24, a pressure reducer 126, a high-pressure hose assembly 30 for providing a fluid connection between the outlet of the pressure reducer 126 and the facepiece 18, a second stage pressure reduction assembly or regulator 28, a power supply 116 and at least one electronics module 134.

The facepiece 18 and most of the components of the SCBA 120 are similar to the corresponding components described previously in conjunction with the first preferred embodiment. However, as has been described previously, the SCBA 120 may utilize an alternative pressure reducer 126 such as the combination quick connect valve and pressure reducer disclosed in the commonly-assigned U.S. patent application Ser. No. 10/884,784. Furthermore, effective use of such a combination pressure reducer 126 preferably involves the use of an improved electronics module 134, such as the one also described in U.S. patent application Ser. No. 10/884,784. Such an electronics module 134 may include a variety of controls and connections for interfacing with the pressure reducer 26, the PAPR 140, electrical devices in or on the facepiece 18, and the like, and preferably includes a controller that determines whether the SCBA 20 or PAPR 140 is operated at any given time. It will be apparent, however, that the use of such an alternative pressure reducer 126 and electronics module 134 is optional.

Figure 16:
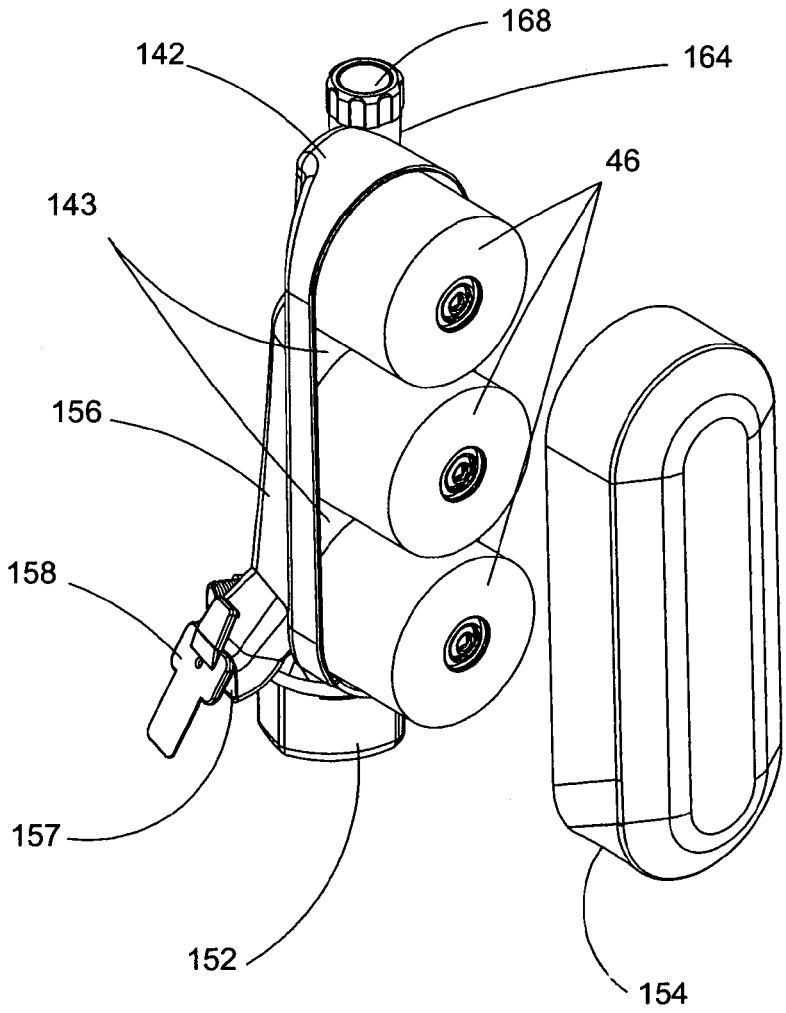
FIG. 16 is a front perspective view of the PAPR of FIG. 15, shown with the cover removed.

Beyond the alternative pressure reducer 126 and electronics module 134, however, the armored PAPR 140 and the carrying frame 121 of the alternative combined air-supplying/armored air-purifying system 110 include alternative features, at least some which will be described in greater detail below. FIG. 15 is a perspective view of the combined system 110 of FIG. 14, showing the PAPR 140 separated from the SCBA 120, and FIG. 16 is a front perspective view of the PAPR 140 of FIG. 15, shown with the cover 154 removed. The PAPR 140 includes a housing 142, a motor housing 150, a cover 154, an inlet duct 156, a plurality of filter canisters 46, a blower 152 and a convoluted hose 70 to attach the outlet of the PAPR 140 to the facepiece 18. Each of these components is described in greater detail below. As described below, the entire assembly 140 may be separated from the SCBA 20 and carried by the user on the user's back, using a simple conventional shoulder harness (not shown) or any other suitable apparatus.

The main body of the PAPR 140 is the PAPR housing 142, which provides support for the various other components, and further includes a battery tube 164 and battery cap 168 for enclosing batteries (not shown) used to power the blower 152. The PAPR housing 142 includes mounting points (not shown) for the filter canisters 46, an attachment point 148 for connecting the PAPR 140 to the SCBA 120, and provides the primary structure of the PAPR 140.

The PAPR housing 142, which is preferably an injection-molded design made from a glass-reinforced nylon material, may be removably mounted on the carrying frame 121 by mating its attachment point 148 to a corresponding attachment point 132 on the carrying frame 121. The attachment point 132 on the carrying frame 121 is particularly adapted to facilitate this connection. Any suitable connection means may be used for this purpose, but a particularly useful means is perhaps best shown in FIG. 15. The attachment point 132 on the carrying frame 121 includes a vertical shaft with a narrow tip extending from a wider-shouldered portion at its upper end and a shelf at its lower end. The attachment point 148 on the PAPR 140 includes a slot adapted to fit over the upper tip of the shaft on the carrying frame 121 and a tab adapted to fir into the shelf on the carrying frame 121. When the slot is positioned on the upper tip, the PAPR housing 142 is supported by the shoulders of the vertical shaft and the shelf, but the PAPR 140 may be easily removed by lifting the housing 142 until the slot is free of the upper tip of the carrying frame attachment point 132.

The motor housing 150 may be a separate section of the PAPR 140, or may be incorporated into the PAPR housing 142. The motor housing 150 holds and retains the blower 152 and provides a pathway for the filtered air to pass from the PAPR housing 142 to the inlet of the blower 152. If the motor housing 150 is separate from the PAPR housing 142, the motor housing 150 may also include a method for attaching it to the PAPR housing 142. The preferred embodiment of the motor housing 150 is an injection-molded design made from a glass-reinforced nylon material.

The PAPR cover 154 attaches to the PAPR housing 142. Together, the PAPR cover 154 and PAPR housing 142 form an enclosure 143 that protects the filter canisters 46 from a heat, flame, high humidity or wet environment, in addition to protecting the canisters 46 from direct physical blows. The PAPR cover 154 may be attached with latches, hinges or other means to hold it securely to the PAPR housing 142. The PAPR cover 154 also includes a seal for the junction between the PAPR cover 154 and the PAPR housing 142 to ensure that ambient environment is kept out of the PAPR 140. The preferred embodiment of the PAPR cover 154 is an injection-molded design made from a glass-reinforced nylon material.

Figure 17:
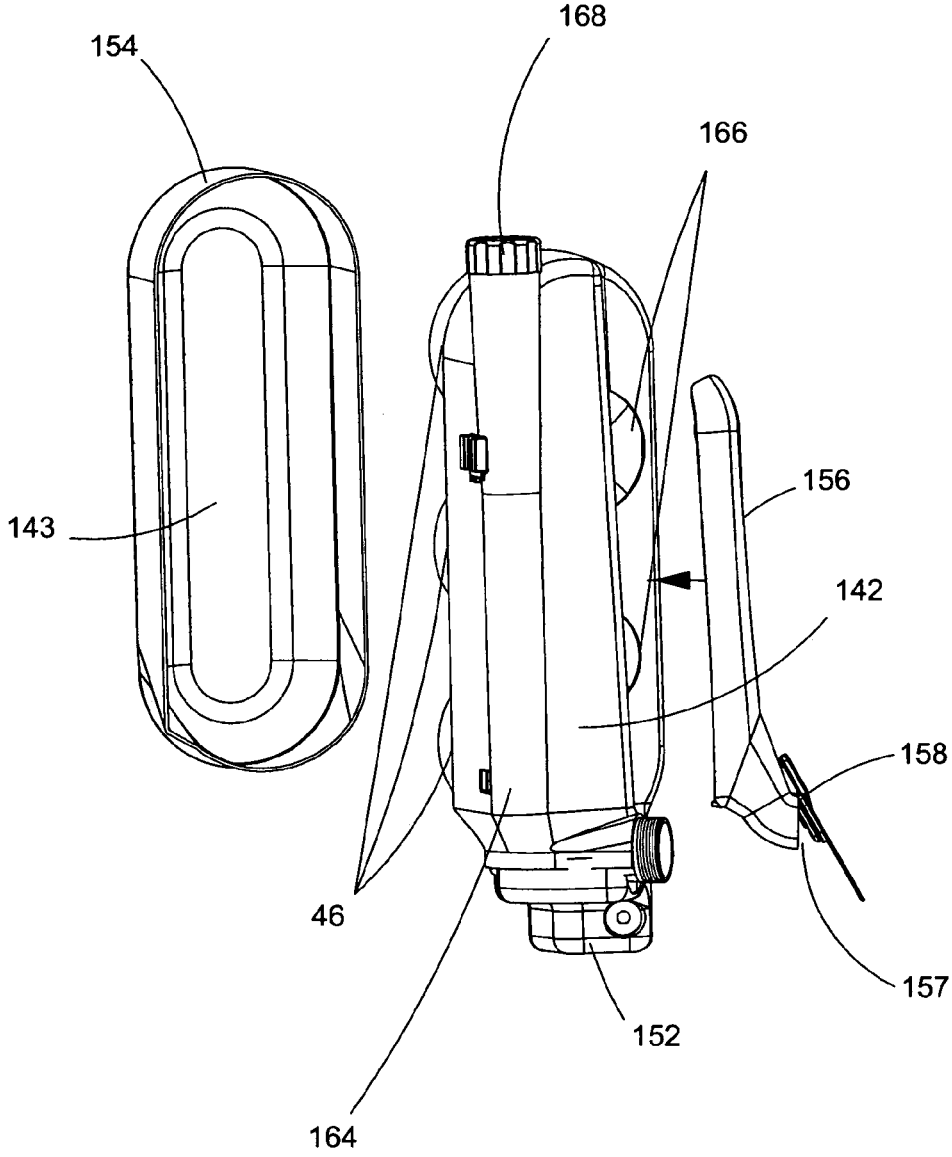
FIG. 17 is rear perspective view of the PAPR of FIG. 16, shown with the cover and the inlet duct removed.

FIG. 17 is rear perspective view of the PAPR 140 of FIG. 16, shown with the cover 154 and the inlet duct 156 removed. The inlet duct 156 provides a pathway for ambient air to pass from an inlet 157 into the PAPR enclosure 143. The inlet duct 156 includes the valve 158 that provides the ability to close off the inlet 157 when the PAPR 140 is not in use. The valve 158 may be a simple inlet cover such as the one illustrated, a plug type design or a more intricate pneumatic or electronic closure method, controlled by the PAPR or. SCBA electronics. In addition, the subject PAPR 140 may optionally be further equipped with a pre-filter 162 on the inlet duct 156 of the PAPR 140, preventing the filter canisters 46 from prematurely being clogged up with particulates that may be in the air. The preferred embodiment of the inlet duct 156 is an injection-molded design made from a glass-reinforced nylon material. The preferred embodiment of the valve 158 is a molded butyl rubber design.

The inlet duct 156 is in fluid communication with the enclosure 143 via one or more duct holes 166. Preferably, all of the canisters 46 are arranged in a single compartment in the enclosure in order to promote greater uniformity in the filtering process and greater control over the distribution of ambient air thereto. Ambient air is drawn into the inlet duct 156 via the inlet 157 and passes into the enclosure 143 via the duct holes 166. Preferably, a plurality of duct holes 166 of varying sizes is provided in order to balance the amount of air flowing to and through the various canisters 46. This may be accomplished by using a relatively small duct hole 166 near the inlet 157 and using progressively larger duct holes 166 as the distance from the inlet 157 increases. As partially illustrated in FIG. 17, the plurality of duct holes 166 preferably includes two semi-circular openings whose relative sizes are varied by changing their respective radii. The inlet duct 156 may be lengthened or otherwise sized in order to guide incoming air to each of the duct holes 166. In this way, the enclosure 143 tends to act as an accumulator, and the size and location of the duct holes 166 ensure that each of the filter canisters 46 have the same amount of airflow.

The blower 152 is arranged in the fluid communication path between the PAPR enclosure 143 and the facepiece 18, and is preferably interposed between the outlet of the PAPR enclosure 143 and the inlet end of the PAPR hose 70. The blower 152 functions to pull air from the PAPR enclosure 143 through the canisters 46, and to pump it through the hose 70 to the interior of the facepiece 18. The blower 152 may be an electronically-controlled centrifugal fan.

Figure 18:
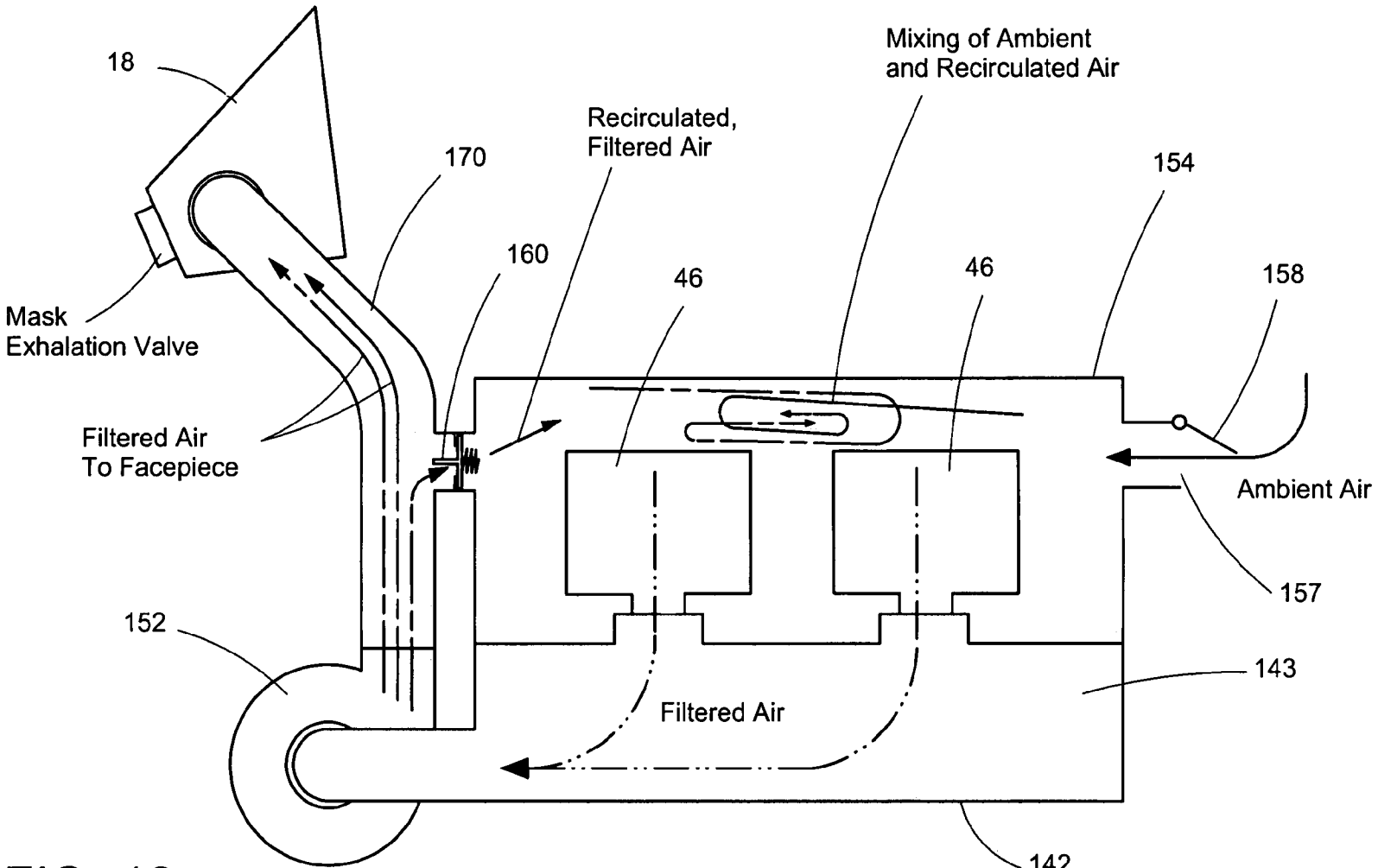
FIG. 18 is a side schematic view of the PAPR of FIG. 15 showing the flow of air therethrough.

FIG. 18 is a side schematic view of the PAPR 140 of FIG. 15 showing the flow of air therethrough. As described previously, it is desirous for the subject PAPR 140 to be of a design such that the user is provided with sufficient air flow rate so as to maintain a positive pressure in the user's facepiece 18 at all times. This PAPR 140 employs a novel feature to deal with both of these problems. The subject PAPR 140 supplies the 300 lpm or higher requirement described above, but employs a recirculation valve 160 in the PAPR housing 142 to address the problem of high exhalation pressures. The recirculation valve 160 is a biased pressure relief valve located in the air path between the PAPR blower 152 and the facepiece 18. The valve 160 is biased to open only when the pressure in the air path between the blower 152 and the facepiece 18 exceeds 1.5" $H_2O$, and is positioned in the PAPR housing 142 in such a manner as to dump the excess air flow into the PAPR enclosure 143.

With this configuration, and assuming a sinusoidal breathing curve, the user is supplied with the 300 lpm or higher during the inhalation portion of the breathing curve maintaining positive pressure in the facepiece 18. During the exhalation portion of the breathing curve, the pressure in the facepiece 18 will rise providing a back pressure to the blower 152 and recirculation valve 160. When this pressure exceeds 1.5" $H_2O$, the recirculation valve 160 opens, relieving the pressure in the facepiece 18 and preventing exhalation pressures from becoming too high for the user (well below 3.5" $H_2O$). An additional benefit of the recirculation valve 160 is that the excess flow of the PAPR 140 is dumped into the PAPR enclosure 143. By dumping this filtered air into the PAPR enclosure 143, the ambient air entering the enclosure is diluted and the relative contaminate concentration is reduced. This reduced concentration in the air will extend the life of the filter canisters 46, and allow the user to dwell longer in the contaminated environment.

As with the first combined system 10, the facepiece 18 in the alternative combined system 110 covers the wearer's nose and mouth in airtight connection, and preferably covers the wearer's eyes with a transparent shield 19 for external viewing. The SCBA hose assembly 30 is interposed between the pressure reducer 26 and the facepiece 18 via the second stage regulator 28 of the SCBA 120. As described previously, the design and operation of this breathing regulator 28 is similar to that used in the combined system 10 of FIG. 1. In addition, the side of the facepiece 18 is preferably equipped with a 40 mm screw-in connection. This provides a connection point for the convoluted hose 70 that attaches the PAPR 140 to the facepiece 18.

As with the first preferred embodiment, the SCBA 120 and the PAPR 140 may be joined or separated easily, using the means illustrated in FIG. 15 or any suitable alternative means. The user is thus once again allowed to choose which type of respiratory protection is required such that the PAPR 140 may be used without the SCBA 120, the SCBA 120 may be used without the PAPR 140, or the two apparatuses 120, 140 may used together, simply by attaching or removing the PAPR 140 from the SCBA 120 as desired. The interoperation of the SCBA 120 with the alternative PAPR 140 is similar to that of the SCBA 120 with the PAPR 40 of the first preferred embodiment.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A powered air-purifying respirator (PAPR), comprising:

a PAPR housing configured to be carried by a user, the housing having inlet and discharge ports;

a canister retention enclosure joined to the inlet port of the PAPR housing, the enclosure including an interior chamber, the enclosure having an external air inlet configured to receive ambient air and having a filtered air port communicating with the inlet port of the PAPR housing;

a plurality of filter canisters located in the interior chamber of the enclosure, each filter canister of which includes an air intake and an air discharge, the air discharges of the each of the filter canisters being removably coupled within the enclosure to communicate with the filtered air port of the enclosure, the enclosure surrounding at least two of the filter canisters, wherein the enclosure includes a manifold joined to the inlet port of the PAPR housing, the manifold having top and bottom plates that receive corresponding ones of the filter canisters; and a blower that draws air through the air inlet of the enclosure into the interior chamber of the enclosure and through the filter canisters.

2. The powered air-purifying respirator of claim 1, wherein the ambient air is distributed to each of the plurality of filter canisters disposed within the interior chamber of the enclosure.

3. The powered air-purifying respirator of claim 1, wherein the enclosure is reinforced to prevent the plurality of filter canisters from being damaged by external forces.

4. The powered air-purifying respirator of claim 1, further comprising a support structure coupled to each of the plurality of filter canisters, the enclosure being mounted to the support structure independent from the filter canisters in order to avoid translating external forces from the enclosure to the filter canisters.

5. The powered air-purifying respirator of claim 1, further comprising a fluid dam disposed in an air path between the inlet port and at least one of the plurality of filter canisters and adapted to prevent liquids from reaching the at least one filter canister.

6. The powered air-purifying respirator of claim 1, wherein the enclosure defines a plurality of separate compartments, and wherein each filter canister is disposed in a different one of the plurality of separate compartments.

7. The powered air-purifying respirator of claim 1, wherein the enclosure includes a manifold joined to the inlet port of the PAPR housing, each of the filter canisters being individually and removably coupled to the manifold.

8. The powered air-purifying respirator of claim 1, wherein the enclosure includes a manifold joined to the inlet port of the PAPR housing, and includes separate covers that cover corresponding ones of the filter canisters.

9. The powered air-purifying respirator of claim 1, wherein the enclosure includes at least one cover covering the filter canisters.

10. An air-purifying respirator, comprising:

a housing;

a canister retention enclosure joined to an inlet port of the housing, the enclosure including an interior chamber, the enclosure having an external air inlet configured to receive ambient air and having a filtered air port communicating with the inlet port of the housing;

a plurality of filter canisters located within the interior chamber of the enclosure, each filter canister including an air intake and an air discharge, the air discharge of each of the filter canisters being removably coupled within the enclosure to communicate with the filtered air port of the enclosure, the enclosure completely enclosing the filter canisters;

a mask; and a fluid connection apparatus that guides filtered air from outlets of the filter canisters to the mask such that the filtered air can be breathed by a user using the mask.

11. The air-purifying respirator of claim 10, further comprising a blower that forces air through the inlet duct, into the interior of the enclosure and through the filter canisters to produce filtered air suitable for breathing.

12. The air-purifying respirator of claim 10, further comprising a distribution portion that directs approximately equal portions of the ambient air that enters the air inlet to each of the filter canisters.

13. An air-purifying respirator, comprising:

a housing;

a canister retention enclosure joined to an inlet port of the housing, the enclosure including a chamber, the enclosure having an external air inlet configured to receive ambient air and having a filtered air port communicating with the inlet port of the housing;

a plurality of filter canisters located in the interior chamber of the enclosure, each filter canister of which includes an air intake and an air discharge, the air discharges of the each of the filter canisters being removably coupled within the enclosure to communicate with the filtered air port of the enclosure, the enclosure surrounding each of the filter canisters;

a distribution portion that directs approximately equal portions of the ambient air that enters the air inlet to each of the filter canisters, wherein the distribution portion is a generally symmetric space having at least two sets of air outlets, each set including one or more air outlets dedicated to directing air to a particular one of the filter canisters; and a fluid connection apparatus that guides filtered air from outlets of the filter canisters to be breathed by a user.

14. The air-purifying respirator of claim 13, wherein the enclosure defines a separate compartment for each of the filter canisters, and wherein each set of air outlets guides air from the chamber to one of the compartments.

15. An air-purifying respirator, comprising:

an enclosure having an enclosed interior;

at least one inlet that guides ambient air to the interior of the enclosure;

a filter canister;

a mask;

a fluid connection apparatus that guides filtered air from an outlet of the filter canister to the mask such that the filtered air can be breathed by a user using the mask; and a fluid dam disposed in an air path between the at least one inlet and the filter canister, the fluid dam including a raised lip positioned to prevent liquids from reaching the filter canister while simultaneously permitting air to flow through the air path and through the filter canister.

16. The air purifying respirator of claim 15, further comprising a blower that forces air through the at least one inlet, into the interior of the enclosure and through the filter canister to produce filtered air suitable for breathing.

17. A powered air-purifying respirator, comprising:

an enclosure having an enclosed interior;

at least one inlet that guides ambient air to an interior of the enclosure;

a filter canister;

a fluid connection apparatus that guides filtered air from an outlet of the filter canister to be breathed by a user; and a fluid dam disposed in an air path between the at least one inlet and the filter canister, the fluid dam including a structure positioned to prevent liquids from reaching the filter canister, wherein a chamber is disposed in the air path between the at least one inlet and the filter canister, the chamber has an air outlet in the bottom thereof, and a fluid dam includes a raised lip extending around a periphery of the air outlet.

18. A powered air-purifying respirator, comprising:

an enclosure having an interior;

at least one inlet that guides ambient air to the interior of the enclosure;

a filter canister;

a fluid connection apparatus that guides filtered air from an outlet of the filter canister to be breathed by a user;

a fluid dam disposed in an air path between the at least one inlet and the filter canister, the fluid dam including a structure positioned to prevent liquids from reaching the filter canister while simultaneously permitting air to flow through the air path and through the filter canister, wherein a chamber is disposed in the air path between the at least one inlet and the filter canister, wherein the chamber has an air outlet in a bottom thereof, wherein the bottom of the chamber defines a first side of the chamber and the fluid dam defines a first fluid dam, wherein the chamber has at least a second air outlet in a second side thereof, wherein a second fluid dam is arranged peripherally around the second air outlet, and wherein the second side of the chamber is oriented in a substantially different direction than the first side, thereby preventing liquids from reaching the filter canister regardless of the orientation of the air-purifying respirator.

19. The air-purifying respirator of claim 18, wherein the second side of the chamber is the top of the chamber, and the second fluid dam extends downwardly from the top of the chamber.

20. The air-purifying respirator of claim 18, wherein a first filter canister is disposed below the chamber and the first air outlet is arranged to guide air to the first filter canister, and wherein a second filter canister is disposed above the chamber and the second air outlet is arranged to guide air to the second filter canister.

21. A portable powered air-purifying respirator, comprising:

a housing adapted to be carried by a user;

a filter canister, mounted on the housing and adapted to filter ambient air, thereby making the ambient air suitable for breathing by the user;

a reinforced enclosure having at least one inlet to permit ambient air to be channeled to the filter canister, the enclosure being mounted on the housing, arranged to surround the filter canister, and adapted to provide protection for the filter canister from flame and heat while the filter canister is being used to filter ambient air for the user; and a blower that forces air through the at least one inlet in the enclosure and through the filter canister to produce filtered air suitable for breathing.

22. The portable powered air-purifying respirator of claim 21, wherein the reinforced enclosure comprises a glass-reinforced nylon material.

23. The portable powered air-purifying respirator of claim 21, further comprising a mask coupled in fluid communication with the filter canister for receiving filtered air from the filter canister.

24. The portable powered air-purifying respirator of claim 21, further comprising a nose cup coupled in fluid communication with the filter canister for receiving filtered air from the filter canister.

25. The portable powered air-purifying respirator of claim 21, further comprising a back frame, wherein the housing is carried by the back frame and the back frame is configured to hold the portable powered air-purifying respirator on a user while the portable powered air-purifying respirator is in use.

26. A portable powered air-purifying respirator, comprising:

a housing adapted to be carried by a user;

a filter canister, mounted on the housing and adapted to filter ambient air, thereby making the ambient air suitable for breathing by the user;

a reinforced enclosure having at least one inlet to permit ambient air to be channeled to the filter canister, the enclosure being mounted on the housing, arranged to surround the filter canister, and adapted to provide protection for the filter canister from flame and heat while the filter canister is being used to filter ambient air for the user; and a blower that forces air through the at least one inlet in the enclosure and through the filter canister to produce filtered air suitable for breathing, wherein the filter canister has an inlet and an outlet, wherein the at least one inlet of the reinforced enclosure is disposed near the outlet of the filter, thereby, causing air that passes through the enclosure and then through the filter canister to be routed along a circuitous path before entering the filter canister.

27. The portable powered air purifying respirator of claim 26, wherein the filter canister may be replaced without replacing the reinforced enclosure.

28. The powered air-purifying respirator of claim 27, wherein the reinforced enclosure is adapted to be temporarily removed to permit the filter canister to be replaced.

29. The powered air-purifying respirator of claim 28, wherein the reinforced enclosure is latched in place during use and temporarily unlatched while the filter canister is being replaced.

30. The powered air-purifying respirator of claim 26, wherein the filter canister includes at least a second filter canister, and wherein the reinforced enclosure includes at least a second reinforced enclosure.

31. The powered air-purifying respirator of claim 26, wherein the housing includes a support structure adapted to receive and retain the filter canister, and wherein the enclosure is primarily mounted to the support structure and not the filter canister in order to avoid translating external forces from the enclosure to the filter canister.

* * * * *